US007142687B2

(12) United States Patent
Hanada

(10) Patent No.: US 7,142,687 B2
(45) Date of Patent: Nov. 28, 2006

(54) ELECTROACOUSTIC CONVERTER

(76) Inventor: Akito Hanada, 3 - 19, Orio 4- chome, Yahatanishi-ku, Kitakyashu-shi Fukuoka 807-0828 (JP)

( * ) Notice: Subject to any disclaimer, the term of this patent is extended or adjusted under 35 U.S.C. 154(b) by 349 days.

(21) Appl. No.: 10/470,693

(22) PCT Filed: Mar. 7, 2002

(86) PCT No.: PCT/JP02/02097

§ 371 (c)(1),
(2), (4) Date: Jul. 31, 2003

(87) PCT Pub. No.: WO02/074009

PCT Pub. Date: Sep. 19, 2002

(65) Prior Publication Data

US 2004/0070294 A1 Apr. 15, 2004

(30) Foreign Application Priority Data

Mar. 9, 2001 (JP) ..... 2001-067699

(51) Int. Cl.
*H04R 25/00* (2006.01)

(52) U.S. Cl. ..... 381/421; 381/412; 381/414

(58) Field of Classification Search ..... 381/152, 381/191, 396, 412–422, 431
See application file for complete search history.

*Primary Examiner*—Suhan Ni
(74) *Attorney, Agent, or Firm*—Sughrue Mion, PLLC

(57) ABSTRACT

An electroacoustic transducer 20, such as a speaker, a headphone, an earphone, a microphone, an acoustic wave sensor, etc., includes magnet plates 21 and 22, the entirety of which are formed like a disk or a ring; and an acoustic diaphragm 23 disposed parallel to said magnet plates 21 and 22 and having a conductor formed on the plane thereof; wherein a component parallel to the vibration plane of said acoustic diaphragm 23 is zero or in the radius direction of said magnet plates 21 and 22 in the direction of magnetizing respective partial areas of said magnet plates 21 and 22, and angles formed by said magnetizing direction with respect to the vibration plane of said acoustic diaphragm 23 are made gradually different from each other in accordance with the distance from the center axis of said magnet plates 21 and 22.

9 Claims, 12 Drawing Sheets

ELECTROACOUSTIC CONVERTER

FIELD OF THE INVENTION

The present invention relates to an electroacoustic transducer that is applied to a speaker, headphone, earphone, etc., which converts electric signals into sound, or a microphone, acoustic wave sensor, etc., which converts received sound into electric signals.

BACKGROUND OF THE INVENTION

Conventionally, an electroacoustic transducer called a "Gamuzon speaker" is such that an acoustic diaphragm having conductor patterns corresponding to a voice coil formed is installed at a pair of intermediate portions of a magnetic field generator, and the acoustic diaphragm is vibrated perpendicular to the vibration plane by supplying a drive current to the conductors.

Since the Gamuzon type electroacoustic transducer has a structure in which conductors are disposed on almost the entire surface of the acoustic diaphragm, the entire surface is driven at the same phase, wherein the electroacoustic transducer has a feature by which a satisfactory transient characteristic can be obtained in a wide range.

The following are proposed as items which belong to such an electroacoustic transducer.

(1) In Japanese Patent Publication No. Sho-35-10420 (hereinafter called Publication (a)), an electroacoustic transducer was proposed, in which adjacent band-shaped magnets (or a band-shaped area in a magnet plate) are disposed with the N and S poles thereof made different from each other, the entirety of a magnet plate including a number of band-shaped magnets is formed to be like a flat plate, and is disposed with the directions of the N and S poles perpendicular to the flat plane, and an acoustic diaphragm, which has conductors formed opposite to the plane of the magnet plate, is disposed.

(2) In Japanese Unexamined Patent Publication No. Sho-51-26523 (hereinafter called Publication (b)), an electroacoustic transducer was proposed, in which an acoustic diaphragm having a conductor deposited between two ring-shaped magnets which are magnetized in the radius direction to the same degree and have uniform thickness, so that the N and S poles are formed on the inner and outer circumferential sides, is disposed, and acoustic waves are radiated from openings formed at the middle of the magnets to the outside thereof.

(3) In Japanese Unexamined Patent Publication No. Sho-59-75799 (hereinafter called Publication (c)), an electroacoustic transducer was disclosed, in which an acoustic diaphragm (plane coil diaphragm) having a pair of flat plate-shaped porous magnet plates opposing each other with fixed spacing in a state repulsing each other, in which the center portion and outer circumferential portion are magnetized with different poles, and having a conductor wound like an eddy therebetween is disposed parallel to the above-described magnet plates.

(4) In Japanese Unexamined Patent Publication No. Sho-52-38915 (hereinafter called Publication (d)), an electroacoustic transducer was described, in which magnet plates (magnetic plates) are constructed with fixed spacing so that a plurality of band-shaped permanent magnets magnetized in the direction parallel to the acoustic diaphragm are disposed with the same poles opposing each other, the above-described magnet plates are disposed on both sides of the acoustic diaphragm having conductors formed thereon, and a number of openings are formed between the band-shaped permanent magnets at the magnet plates on at least one side.

(5) In Japanese Unexamined Patent Publication No. Sho-57-23394 (hereinafter called Publication (e)), an electroacoustic transducer was proposed, in which an acoustic diaphragm is installed, which has a plurality of spiral conductors formed between a pair of flat and porous permanent magnet plates concentrically including a plurality of annular N and S poles, which are divided by an annular transient plane area, in a state where adjacent magnetic poles are turned into different poles, and acoustic waves are radiated from the pores of the magnet plates to the outside thereof.

However, in the above-described prior art electroacoustic transducers, there are the following problems and shortcomings.

(1) In the electroacoustic transducer described in Publication (a), since the N and S poles are disposed with the directions thereof made different from each other by turns, the direction of a magnetic flux greatly changes, wherein the density of the magnetic flux to drive the acoustic diaphragm in the direction perpendicular to the plane, that is, the density (hereinafter called "effective operating magnetic flux density") of a magnetic flux (hereinafter called an "effective operating magnetic flux"), in which the direction of an electromagnetic force operating in the conductors of the acoustic diaphragm is the vibration direction, greatly changes with respect to the vibration direction, wherein there is a problem in that this becomes a cause of non-linear distortion that deteriorates the acoustic quality.

(2) Where the directions of the N and S poles of the band-like magnets are made different from each other by turns as in Publication (a), the effective operating magnetic flux that becomes parallel to the vibration plane of the acoustic diaphragm increases its density in an area of the acoustic diaphragm opposite to the intermediate portion in adjacent band-shaped magnets, and decreases its density at the portion of the diaphragm opposite to the band-shaped magnets. Therefore, it is difficult to smoothly and continuously form areas having a prescribed effective operating magnetic flux density, and a uniform drive force cannot be obtained on the entire surface of the acoustic diaphragm, wherein a completely entire-surface-drive type speaker having satisfactory vibration characteristics cannot be obtained.

(3) Further, since it is necessary to wind conductors alternately in inverse directions in response to the effective operating magnetic fluxes which alternately become inverse, and to adequately dispose the conductors in an area of narrow width, which has a prescribed magnetic flux density, high working accuracy is required, wherein there is a problem in that productivity thereof is lowered.

(4) In the electroacoustic transducer, described in Publication (b), having an acoustic diaphragm disposed between ring-shaped magnets of uniform thickness, which are magnetized in the radius direction to the same degree, the ring-shaped magnets are not magnetized by partial areas, but are magnetized integrally on the entire inner circumferential side and the entire outer circumferential side so as to form N and S poles. In the case of the ring-shaped magnets, since the total magnetic fluxes at the N pole side and those at the S pole side are always equal to each other although the effective area of the magnetic pole at the outer circumferential side becomes wider than the effective area of the magnetic pole at the inner circumferential side due to a difference in the radius, the magnetic flux density at the outer circumferential side is further lowered than that at the inner circumferential side, and the effective operating magnetic flux density is also lowered. Therefore, the wider the width between the outer diameter of the ring-shaped magnets and the inner diameter thereof, that is, in the radius direction, the larger becomes a difference between the effective area of the outer circumferential side magnetic pole and that of the inner circumferential side magnetic pole, wherein the effective operating magnetic flux density is lowered. Therefore, it was necessary to make the width in the radius direction narrow for use. Accordingly, the design conditions are narrowed, wherein there is a problem in that it is difficult to obtain an electroacoustic transducer which is excellent in the acoustic characteristics adapted to various types of conditions.

(5) In addition, a method for magnetizing the entirety with magnetic poles, which constitute a pair, disposed at the inner circumferential edge side and outer circumferential edge side has been known as the method for magnetizing such a ring-shaped magnet. However, as the width in the radius direction of the ring shape is widened, a difference arises in the magnetization intensity due to a difference in the area of the magnetic poles at the inner circumferential side and outer circumferential side, whereby the inner circumferential portion is first magnetically saturated, and intensive and uniform magnetization was difficult.

(6) In order to reduce such problems of saturation in magnetization and lowering in the above-described magnetic flux density in the vicinity of the outer circumference of the ring-shaped magnets, it was necessary to use a magnet in which the width in the radius direction of the ring shape is narrowed. Therefore, since it is not possible to increase the area between the outer diameter of the ring shape and the inner diameter thereof, that is, of a part contributing to vibrations of the acoustic diaphragm, it is difficult to widely form a highly effective operating magnetic flux density, wherein there is a problem in that the utilization efficiency of the magnetic flux is further deteriorated.

(7) In the electroacoustic transducer using porous magnet plates, which is described in Publication (c), acoustic waves can be discharged outward through acoustic pores formed on the magnet plate. However, the direction of magnetizing the porous magnet plates disposed opposite to each other is made to have an angle by which the entirety of the magnet plates are integrated and concentrated to form N and S poles, wherein since the angle is not adjusted to the optimal angle to increase the effective operating magnetic flux density of the acoustic diaphragm with respect to a conductor, there is a problem in that the utilization efficiency of the magnetic flux is deteriorated. That is, the ratio between value (U) obtained by adding up the effective operating magnetic flux in the conductor of the acoustic diaphragm by the area of the conductor and the total cubic volume (V) of the magnet plates, that is, the effective operating magnetic flux per unit cubic volume of the magnet plates, which is shown by U/V (hereinafter called "effective operating magnetic flux ratio") is lowered. Further, in the direction of magnetizing such magnet plates, since it is difficult to partially correct the effective operating magnetic flux density of the acoustic diaphragm with respect to the conductor, there is a problem in that a change in the effective operating magnetic flux density of the acoustic diaphragm with respect to the radius direction increases.

(8) In the electroacoustic transducer having a number of openings between the band-shaped permanent magnets, which is described in Publication (d), a number of openings formed in the magnet plates are turned up and disposed in the longitudinal and lateral directions so that the entire arrangement profile thereof becomes rectangular. Therefore, since the arrangement profile of a diaphragm formed like a disk is not coincident with the arrangement profile of the openings that become rectangular, vibrations at the circumferential disk-shaped edges become irregular due to influences in the load distribution of the diaphragm, and there is a problem in that the quality of sound to be reproduced is deteriorated.

(9) Also, since areas having a prescribed effective operating magnetic flux density cannot be continuously formed in the installation position of the acoustic diaphragm, it is not possible to dispose conductors on the entire surface of the acoustic diaphragm, wherein there is a problem in that the entire-surface-drive type speaker cannot be obtained, which has satisfactory vibration characteristics.

(10) In the electroacoustic transducer, described in Publication (e), in which an acoustic diaphragm is installed between a pair of flat porous permanent magnet plates concentrically having a plurality of annular N and S poles divided by annular transient plane areas so that adjacent magnetic poles thereof have a pole different from each other, the annular N and S poles in respective ring-shaped magnets that constitute magnet plates are divided by the annular transient plane areas. That is, the N and S poles are not formed in the partial area units in the respective ring-shaped magnets, but are integrally formed at the entire inner circumferential side and the entire outer circumferential side. In the case of the ring-shaped magnet, although the effective area of the outer circumferential side magnetic pole is made wider than the effective area of the inner circumferential side magnetic pole due to a difference in the radii, the total magnetic fluxes at the N pole side are always equal to the total magnetic fluxes at the S pole side in the magnets. Therefore, even if the magnetic flux density at the outer circumferential side is further lowered than that at the inner circumferential side, the effective operating magnetic flux density is also lowered as shown in FIG. 5B described later. Since the further the ring-shaped magnet in the radius direction is widened, the larger becomes the difference between the effective area of the outer circumferential side magnetic pole and that of the inner circumferential side magnetic pole, it is necessary to narrow the width thereof in the radius direction for use, wherein there is a problem in that the design conditions are limited in terms of obtaining an electroacoustic transducer whose converting efficiency of energy is excellent with a low distortion factor.

(11) Also, a method for magnetizing the entirety of the magnet by disposing a pair of magnetic poles at the inner circumferential edge side and outer circumferential edge side has been publicly known as a method for magnetizing the respective ring-shaped magnets. However, if the width of the ring shape in the radius direction becomes wide, a difference is generated in the magnetizing intensity due to a difference in the area of the magnetic poles between the inner circumferential side and the outer circumferential side, wherein the inner circumferential portion is first magnetically saturated, and intensive and uniform magnetization was difficult. Accordingly, there is a problem in that the width of the ring-shaped magnets in the radius direction is limited.

(12) In order to reduce such problems of saturation in magnetization and lowering in the above-described magnetic flux density in the vicinity of the outer circumference of the ring-shaped magnets, it was necessary to use magnets in which the width of the ring shape in the radius direction is narrowed. Therefore, a combination of a plurality of ring-shaped magnets whose magnetizing directions differ from each other is made into a magnet plate, wherein it was necessary to construct an acoustic diaphragm by combining a plurality of spiral-shaped conductors. Therefore, since such respective combined spiral-shaped conductors independently vibrate (divided vibrations), wherein uniform vibrations of the acoustic diaphragm are obstructed, it was difficult to obtain acoustic characteristics having little distortion.

The present invention was developed to solve the above-described problems, and it is therefore an object of the invention to provide an electroacoustic transducer such as a speaker, headphone, earphone, microphone, acoustic wave sensor, etc., which are able to widely set a distribution of an effective operating magnetic flux density required for a conductor of an acoustic diaphragm and the vibration direction thereof, suppress distortions by uniformly vibrating the acoustic diaphragm, and efficiently convert electric signals into sound, or sound into electric signals, and does not require any high machining accuracy in production.

SUMMARY OF THE INVENTION

The invention includes the following constructions in order to achieve the above-described object;

The electroacoustic transducer according to the first aspect of the invention is an electroacoustic transducer comprising: magnet plates, the entirety of which are formed like a disk or a ring; and an acoustic diaphragm disposed parallel to the above-described magnet plates and having a conductor formed on the plane thereof, wherein a component parallel to the vibration plane of the above-described acoustic diaphragm is zero or in the radius direction of the above-described magnet plates in the magnetizing direction of respective partial areas of the above-described magnet plates, and angles formed by the above-described magnetizing direction with respect to the vibration plane of the above-described acoustic diaphragm are made gradually different from each other in accordance with the distance from the center axis of the above-described magnet plates.

With such a construction, the following actions can be obtained.

(a) Since the magnetizing direction can be set by adjusting the direction for magnetization in respective partial areas of magnet plates so that the contribution to the effective operating magnetic flux of the acoustic diaphragm with respect to the conductor is maximized, it is possible to effectively generate the magnetic flux in the radius direction along the vibration plane of the acoustic diaphragm, wherein an area having a highly effective operating magnetic flux density can be secured in a considerably wide range.

(b) Since the area in which the effective operating magnetic flux density is made high can be secured in a considerably wide range at the position of the acoustic diaphragm, it is possible to generate a drive force resulting from an electromagnetic force on the entire surface of the acoustic diaphragm having a conductor disposed thereon, whereby it becomes possible to design an acoustic diaphragm in which the entire surface of the vibration plane can be actuated in the same phase, and an entire-surface-drive type plane speaker having an ideal low distortion factor can be obtained.

(c) While securing an area of a necessary effective operating magnetic flux density in a wide range since the magnetizing directions of the magnet plates in the respective partial areas are set to respective prescribed angles with respect to the vibration plane of the acoustic diaphragm, the effective operating magnetic flux density in the respective positions in the vibration direction of the acoustic diaphragm has a distribution having slight changes. Therefore, distortion resulting from a difference with respect to the degree in the effective operating magnetic flux density in the vibration direction of the acoustic diaphragm can be controlled, the quality of sound generated in a speaker, headphone, etc., and electric signals converted from sound in a microphone, etc., can be maintained at a favorable level.

(d) Since, in the case of disposing an acoustic diaphragm parallel to and between two magnet plates as a pair, a change in the effective operating magnetic flux density with respect to the vibration direction can be decreased in comparison to the case where a single magnet plate is provided, an excellent sound quality can be maintained in a case where the amplitude of the acoustic diaphragm becomes large or a difference is more or less generated in the installation position of the acoustic diaphragm.

(e) Where an acoustic diaphragm is disposed between two magnet plates, the effective operating magnetic flux density can be increased in comparison to the case where a single magnet plate is provided.

Herein, the magnet plates are such that the entire magnet material is made disk-shaped or ring-shaped, and magnetization of partial areas of the magnet material is made in a prescribed direction and in a prescribed intensity.

Two magnet plates may be disposed opposite to both the front and rear sides of the acoustic diaphragm or one magnet plate may be disposed opposite to the acoustic diaphragm.

Where two magnet plates are disposed opposite to both the front and rear sides of the acoustic diaphragm with the same plate placed therebetween, if the thickness of one of the magnet plates is made thinner than that of the other one, or the distribution of thickness of the respective magnet plates is varied, it is possible to adjust the direction and intensity of the magnetic field in the acoustic diaphragm. Thereby, features in the case where two magnet plates are disposed at both sides of the acoustic diaphragm, and features in the case where a single magnet plate is disposed at one side are complemented and adjusted, and it is possible to control the acoustic characteristics at a prescribed state.

Where two magnet plates are disposed opposite to both the front and rear sides of the acoustic diaphragm, the direction of magnetizing partial areas in the two magnet plates is generally determined so as to become symmetrical with respect to the vibration plane of the acoustic diaphragm. However, where the mutual thickness or the distribution of the thickness of the two magnet plates is varied, there may be a case where the magnetizing direction is not made symmetrical in order to improve the utilization efficiency of magnetic fluxes and the uniformity in the distribution of magnetic fluxes in the vicinity of the acoustic diaphragm.

Where the magnetizing directions in the respective partial areas of the magnet plates are established so as to gradually differ from each other with respect to the vibration plane of the acoustic diaphragm, the magnetizing directions of the respective partial areas are not an angle at which the entirety of the magnet plates are integrally concentrated to form N and S poles, but an angle at which the respective partial areas form independent magnetic poles differing from each other.

In addition, the magnetizing direction in a specified partial area may be determined so that a component parallel to the vibration plane of the acoustic diaphragm becomes zero, that is, the magnetizing direction may be determined to be perpendicular to the vibration plane of the acoustic diaphragm, wherein it becomes possible to flexibly adjust the magnetizing direction, and it becomes easy to make adequate adjustment of the effective operating magnetic flux density which is formed on the acoustic diaphragm by the magnet plates.

Also, it is preferable that the partial areas are formed by dividing the magnet plates into small sections and the angles of magnetizing between the adjacent partial areas are optimized by making the angles to gradually differ from each other, whereby unevenness in the distribution of magnetic fluxes can be reduced, and an electroacoustic transducer having acoustic characteristics with little distortion can be achieved. That is, unless difficulty in production is taken into consideration, it is ideal that the magnetizing angles in the adjacent partial areas are gradually and continuously optimized in the radius direction and thickness direction.

Permanent magnets such as a neodymium-iron-boron-based (hereinafter called "neodymium-based") or Sm—Co-based rare earth magnet, ferrite magnet, KS steel magnet, MK steel magnet, OP magnet, new KS steel magnet, alnico magnet, etc., may be used as the materials of such magnet plates.

An acoustic diaphragm having a conductor formed thereon may be spiral, coil-like or such that a circuit is formed as a labyrinth-shaped pattern which is formed by repeating rectangular turn-ups of conductors such as aluminum, copper, silver, gold, etc., on a thin substrate material composed of synthetic resins such as polyimide, polyethylene, polycarbonate, etc., being a non-magnetic material, ceramic, synthetic fabric, wood-based fabric or a composite material thereof by means of deposition and etching, etc. Also, in the acoustic diaphragm, a non-magnetic thin film acting as a carrier may be omitted by forming an insulated coil acting as a conductor so as to become like a plane.

An electroacoustic transducer according to the second aspect of the invention is an electroacoustic transducer comprising: magnet plates, the entirety of which are formed like a disk or a ring; and an acoustic diaphragm disposed parallel to the above-described magnet plates and having a conductor formed on the plane thereof, wherein a component parallel to the vibration plane of the above-described acoustic diaphragm is in the radius direction of the above-described magnet plates in the magnetizing direction of respective partial areas of the above-described magnet plates, and the angle established by the above-described magnetizing direction with respect to the vibration plane of the above-described acoustic diaphragm is made into a fixed value.

With such a construction, the following actions can be obtained in addition to those in the first aspect.

(a) Since the magnetizing direction of the magnet plates is determined at a constant angle with respect to the vibration plane of the acoustic diaphragm, it becomes easier to design and manufacture the magnet plates in comparison to a case where the magnetizing direction of the magnet plates is determined to be an angle that is caused to gradually differ with respect to the distance from the center axis of the magnet plates.

(b) Since the magnetizing direction of the magnet plates is determined at a constant angle with respect to the vibration plane of the acoustic diaphragm, a difference in the effective operating magnetic flux density with respect to the radius direction of the acoustic diaphragm can be reduced in comparison to a case where the magnetizing direction is determined to be an angle at which the magnetizing directions gradually differ from each other with respect to the distance from the center axis, and compensation necessary to optimize the distribution of the effective operating magnetic flux densities can be reduced.

(c) Where the effective operating magnetic flux density is corrected by varying the distribution of thickness of the magnet plates, the correcting amount based on the thickness can be reduced, and influences upon the acoustic characteristics, which are exerted by the depth thereof can be reduced in the acoustic pores formed in the magnet plates.

An electroacoustic transducer according to the third aspect of the invention is constructed, in the electroacoustic transducer as set forth in the first or second aspects of the invention, so that the above-described magnet plates are formed by an aggregate of small magnets corresponding to the above-described respective partial areas.

Thereby, the following actions can be obtained in addition to those of the first or second aspect of the invention.

(a) Even if the magnet plate has a complicated magnetizing pattern since the magnet plate is composed of an aggregate of small magnets, it can be comparatively easily achieved by arranging a number of small magnets that are magnetized in advance at prescribed angles.

(b) Since the entirety of the magnet plate can be formed by aggregating small magnets, intensive magnetization is independently enabled on the respective small magnets, and it becomes easy to produce a magnet plate that maximizes the performance of magnet materials.

(c) It becomes easy to vary the magnetizing angle, magnetizing intensity, size, etc., of the respective small magnets that constitute the magnet plate in a prescribed value, whereby the distribution state of the effective operating magnetic flux densities in the conductor of the acoustic diaphragm can be easily adjusted in accordance with the acoustic characteristics required.

(d) Since gaps between small magnets can be utilized as acoustic pores, no drilling work is required to produce acoustic pores, wherein an electroacoustic transducer having excellent sound quality can be simply constructed.

(e) Since the magnet plates can be formed by using the same shape of small magnets which have the same magnetizing intensity, and disposing the small magnets while varying the angles thereof with respect to the vibration plane of the acoustic diaphragm of the respective N and S poles, it is possible to produce an electroacoustic transducer using inexpensive standardized materials. In this case, disk-shaped magnets magnetized in the diametrical direction are used as the small magnets, and the planes of the small magnets are made perpendicular to the plane of the magnet plate and the small magnets are concentrically disposed so that the diametrical direction thereof is made into the radius direction of the magnet plate. And, if the small magnets are used with the angles of the N and S poles varied, influences exerted by the profile of the small magnets due to a change in the angle thereof with respect to the acoustic pores and surrounding small magnets can be reduced.

Herein, permanent magnets and electromagnets may be used as the small magnets. A magnet plate can be constructed, in which the small magnets are collected and arrayed on the plane, and the entirety thereof is made disk-shaped or ring-shaped. The independent shape of the small magnets may be, for example, rod-shaped, rectangular-shaped, disk-shaped, ring-shaped, and fan-shaped, or may be composed of elements in which the disk-shaped or ring-shaped portions are divided into small parts.

The assembly of small magnets is achieved by bonding the entirety of a number of small magnets, which are magnetized in a prescribed direction, with a synthetic resin such as polyethylene, polycarbonate, polyimide-based, etc., and a synthetic resin-based adhesive agent such as epoxy, cyanoacrylate-based, etc., or an inorganic-based adhesive agent, by constructing the entirety of small magnets like a disk or a ring using a frame member, etc., made of a non-magnetic material, in which respective small magnets are fitted.

An electroacoustic transducer according to the fourth aspect of the invention is constructed, in the electroacoustic transducer as set forth in the first aspect through the third aspect of the invention, so that the above-described magnet plates, the entirety of which are formed like a disk or a ring, has a thickness that gradually increases from the outer circumferential edge side thereof toward the center axis side.

With such a construction, the following actions can be obtained in addition to those of the first aspect through the third aspect of the invention.

(a) By gradually increasing the thickness of the magnet plate from the outer circumferential edge side toward the center axis side and causing the contribution of magnetic fields at respective positions of the magnet plate to gradually differ from each other, it is possible to increase the effective operating magnetic flux density at the center axis side with respect to a case where the effective operating magnetic flux density is liable to be lowered at the center axis side of the acoustic diaphragm. Thereby, it is possible to set the distribution of the effective operating magnetic flux densities in a conductor of the acoustic diaphragm to a pattern along which the acoustic diaphragm makes uniform vibrations, and the vibration characteristics of the acoustic diaphragm can be easily optimized.

(b) Where a supporting portion of the magnet plate is placed at the center axis side and outer circumferential edge side of the magnet plate, since the central portion of the magnet plate, at which the supporting strength is most required, is thickened, a structure which is excellent in terms of strength, can be obtained.

(c) Since the thickness of the magnet plate is gradually varied and the center axis side is made thick, it is possible to gradually and gently vary the depth of acoustic pores that are drilled in the magnet plate, whereby the acoustic impedance that varies along with the depth of the acoustic pores is not radically changed, and it is possible to prevent irregular vibrations at the acoustic diaphragm.

An electroacoustic transducer according to the fifth aspect of the invention is constructed, in the electroacoustic transducer as set forth in the first aspect through the third aspect so that, in the above-described magnet plates, the entirety of which are formed like a disk or a ring, have the thickness at the intermediate portion between the center axis side and outer circumferential side thereof, which is thicker than those at the above-described center axis side and the above-described outer circumferential edge side.

With such a construction, the following actions can be obtained in addition to those of any one of the first aspect through the third aspect of the invention.

(a) By making the thickness at the intermediate portion between the center axis side and the outer circumferential edge side thicker than that at the above-described center axis side and the above-described outer circumferential edge side in the magnet plate and causing the contribution of magnetic fields at respective positions of the magnet plate to gradually differ from each other, it is possible to increase the effective operating magnetic flux density at the above-described intermediate portion particular to a case where the effective operating magnetic flux density is lowered at the above-described intermediate portion of the acoustic diaphragm. Thereby, it is possible to set the distribution of the effective operating magnetic flux densities in a conductor of the acoustic diaphragm to a pattern along which the acoustic diaphragm makes uniform vibrations, and it is possible to propose an electroacoustic transducer which is excellent in terms of acoustic characteristics.

(b) Since the portion where the magnet plate becomes thick is the intermediate portion in the radius direction, such a structure in which thick portions are not concentrated at one part can be obtained, whereby influences on the acoustic impedance, which are exerted by the depth of the acoustic pores drilled in the magnet plate can be totally dispersed, and partial uneven acoustic impedance can be reduced. Therefore, it is possible to prevent the acoustic diaphragm from irregular vibrations.

An electroacoustic transducer according to the sixth aspect of the invention is constructed, in the electroacoustic transducer as described in any one of the first aspect through the fifth aspect, so that the above-described magnet plates are provided with acoustic pores that allow acoustic waves generated outside or inside to pass therethrough.

With such a construction, the following actions can be obtained in addition to those of any one of the first aspect through the fifth aspect of the invention.

(a) Since a number of acoustic pores that allows acoustic waves to pass through are formed in the magnet plate, acoustic waves generated in the entire range of the acoustic diaphragm can be discharged by reducing interference with each other in a speaker, headphone, etc., and electric signals having little distortion can be obtained in a microphone, etc., by reducing interference with sound received from the outside thereof.

(b) Where an acoustic diaphragm is provided between two magnet plates, acoustic pores may be provided in either one or both of the magnet plates. Where acoustic pores are formed in both of the magnet plates, the entire structure may be made symmetrical with respect to the vibration plane of the acoustic diaphragm. Therefore, an acoustically excellent structure can be obtained with respect to vibrations of the acoustic diaphragm.

Herein, the acoustic pores are openings formed in the magnet plates. The acoustic pores are generally formed so that the center axes of the pores are provided in the direction perpendicular to the vibration plane of the acoustic diaphragm. However, the acoustic characteristics and collecting acoustic reflection performance thereof can be improved by tilting the center axis, or providing an inclined portion in which the inner walls of the pores are enlarged or contracted in advancement of sounds.

An electroacoustic transducer according to the seventh aspect of the invention is constructed, in the electroacoustic transducer as set forth in the sixth aspect of the invention, so that the size, arrangement density, and arrangement pattern of the above-described acoustic pores disposed in the above-described magnet plates are caused to gradually differ from each other from the center axis side of the above-described magnet plates to the outer circumferential edge side thereof.

With such a construction, the following actions can be obtained in addition to those of the sixth aspect.

(a) Since the distribution state of the effective operating magnetic flux densities in a conductor of the acoustic diaphragm can be adjusted by the arrangement state of the acoustic pores formed in the magnet plates, the distribution of the effective operating magnetic flux densities can be set to a pattern at which the acoustic diaphragm uniformly vibrates, wherein an electroacoustic transducer having excellent acoustic characteristics can be provided.

(b) Since the acoustic impedance can be adjusted by the arrangement state of the acoustic pores formed in the magnet plates, it is possible to optimize the transmission characteristics of acoustic waves generated in or received by the acoustic diaphragm and vibration characteristics of the acoustic diaphragm.

(c) By using a combination with those of varying the thickness and magnetic intensity of the magnet plates with respect to adjustment of the effective operating magnetic flux densities distribution in a conductor of the acoustic diaphragm, it becomes possible to easily set the distribution of the effective operating magnetic flux densities formed in the conductor of the acoustic diaphragm to a pattern at which the acoustic diaphragm uniformly vibrates.

The size, arrangement density, and arrangement pattern of the acoustic pores, and the thickness pattern in the case of varying the thickness of the above-described magnet plates can be established through simulation based on the finite element method using such a computer as that described below. That is, with respect to a model of a magnet plate, the data thereof are incorporated in simulation program in advance, and the distribution of the effective operating magnetic flux densities in the vicinity of an acoustic diaphragm is devised so as to be computed. Thus, by varying and adjusting data regarding the thickness at respective positions of the magnet plate and data regarding the size and arrangement of the acoustic pores thereof, the optimal values thereof can be obtained so that the effective operating magnetic flux densities become a prescribed distribution on the basis of the caluculation results.

An electroacoustic transducer according to the eighth aspect of the invention is such that a plurality of the electroacoustic transducers as set forth in any one of the first aspect through the seventh aspect are concentrically disposed with the sizes thereof differed from each other.

With such a construction, the following actions can be obtained in addition to those of any one of the first aspect through the seventh aspect of the invention.

(a) Since independent electroacoustic transducers that are different from each other in terms of sizes and acoustic characteristics thereof are concentrically (coaxially) constructed, and the entirety thereof is made into a composite type electroacoustic transducer, the electroacoustic transducers can be integrally and optimally disposed in accordance with application conditions such as a radiation area of acoustic waves, electric impedance, etc., wherein an electroacoustic transducer having excellent acoustic characteristics can be obtained. For example, if respective electroacoustic transducers are combined per frequency band for high frequency band, mid frequency band, and low frequency band, a composite type electroacoustic transducer can be easily constructed, which has excellent features in all the frequency bands.

(b) Even in a case where the radius of the magnet plate becomes large, and the utilization efficiency of magnetic fluxes is deteriorated due to a lowering in the effective operating magnetic flux ratio, the entirety of the magnet plate is divided into a plurality of ring-shaped magnet plates, and N and S poles of the respective divided magnet plates adjacent to each other are, respectively, established in inverse directions, wherein it is possible to prevent the effective operating magnetic flux ratio from lowering.

(c) Since electroacoustic transducers having different acoustic characteristics are coaxially disposed to be made into a composite type, it is possible to propose an electroacoustic transducer having excellent phase characteristics and directivity characteristics.

An electroacoustic transducer according to the ninth aspect of the invention is constructed, in the electroacoustic transducer as set forth in the first aspect through the third aspect, so that the above-described magnet plates which are formed like a disk or ring as the entirety have a thinner thickness at the intermediate portion between the center axis side and the outer circumferential edge side thereof than those at the central portion and the outer circumferential portion.

With such a construction, the following actions can be obtained in addition to those of any one of the first aspect through the third aspect.

(a) Since the thickness at the intermediate portion between the center axis side and the outer circumferential edge side is made thinner than that at the central portion and the outer circumference portion in the magnet plate, it is possible to discharge acoustic waves generated from the acoustic diaphragm outsides with the interference brought about by the magnet plate being reduced. In addition, if the thickness is made remarkably thin at the intermediate portion of the magnet plate or the magnet plate is removed at the intermediate portion, and almost the entirety of the magnet plate is provided only at the central portion and the outer circumferential portion, the interference brought about by the magnet plate can be completely removed with respect to acoustic waves generated from the acoustic diaphragm.

(b) The central portion and outer circumferential portion of the magnet plate is made thick with the distribution of thickness at the intermediate portion of the magnet plate maintained at a pattern by which prescribed acoustic performance can be obtained, whereby the converting efficiency of energy can be improved with the effective operating magnetic flux density increased, without increasing the interference brought about by the magnet plate with respect to acoustic waves generated from the acoustic diaphragm.

(c) By forming the thickness at the intermediate portion of the magnet plate thinner than that at the central portion and outer circumferential portion, it is possible to lower the effective operating magnetic flux density of the above-described intermediate portion particular to a case where the effective operating magnetic flux density of the above-described intermediate portion of the acoustic diaphragm is excessively high. Thereby, the distribution of the effective operating magnetic flux densities in a conductor of the acoustic diaphragm can be set to a pattern at which the acoustic diaphragm uniformly vibrates, and an electroacoustic transducer having excellent acoustic characteristics can be proposed.

DETAILED DESCRIPTION OF EMBODIMENTS OF THE INVENTION

Hereinafter, a description is given of embodiments of the invention with reference to the accompanying drawings.

(Embodiment 1)

Figure 1:
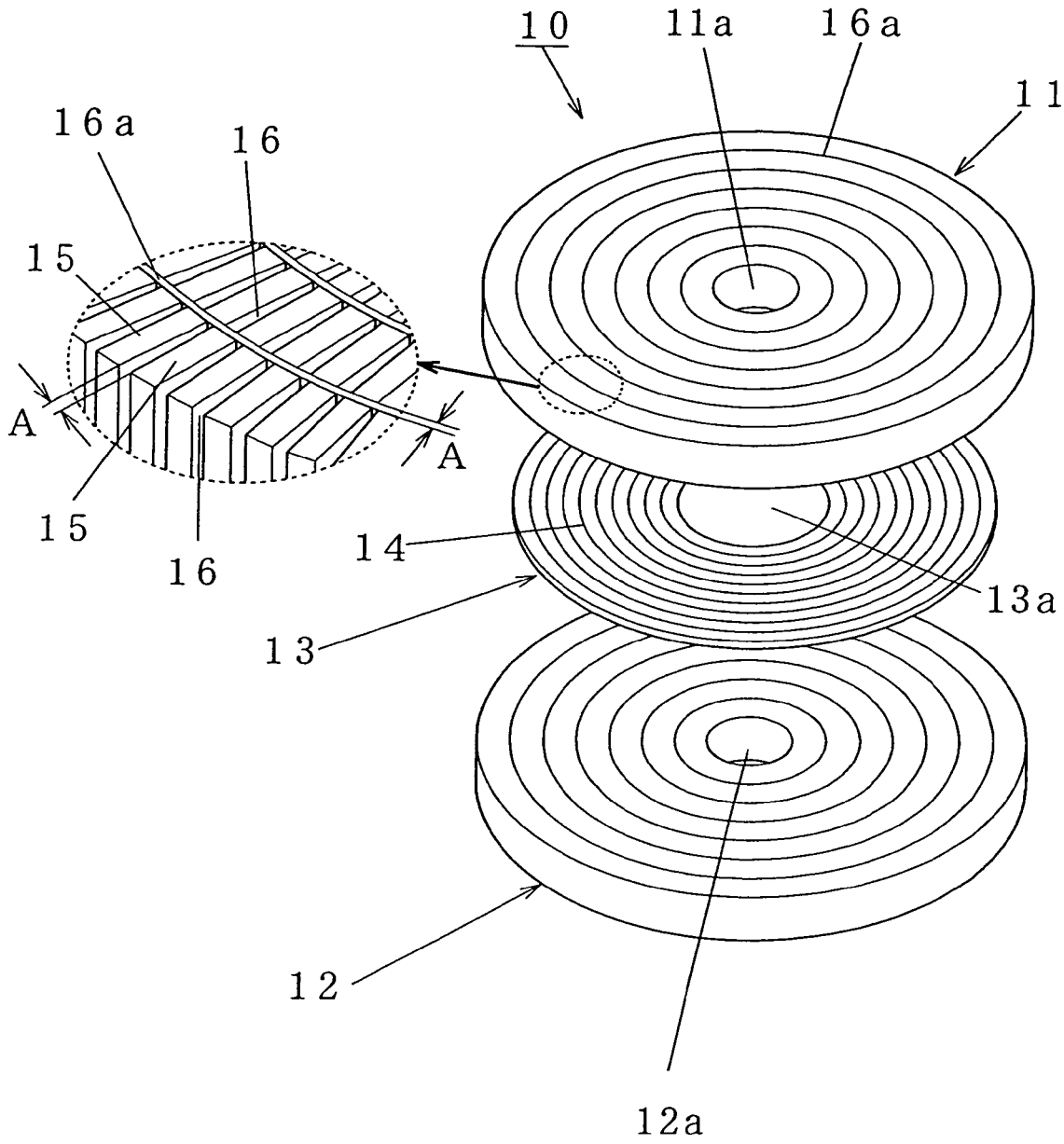
FIG. 1 is a disassembled perspective view of an electroacoustic transducer according to Embodiment 1.
Figure 2:
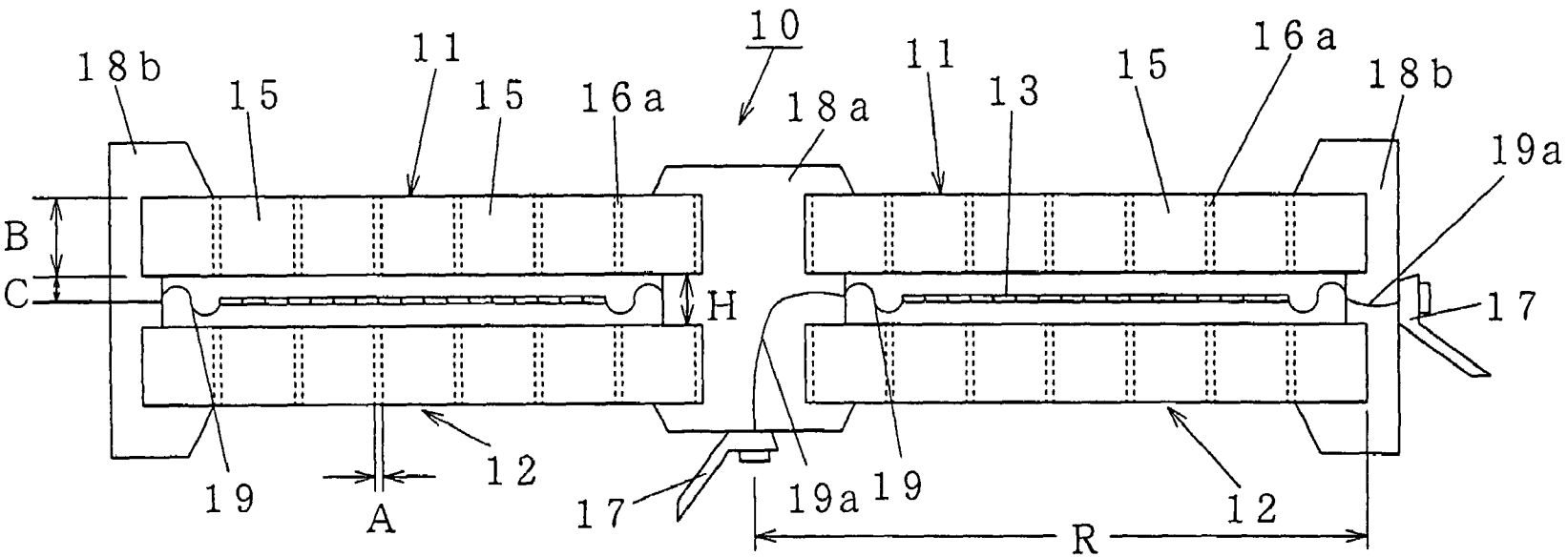
FIG. 2 is a sectional view showing the major parts of an electroacoustic transducer according to Embodiment 1.

FIG. 1 is a disassembled perspective view of an electroacoustic transducer according to Embodiment 1, and FIG. 2 is a sectional view showing the major parts thereof.

In FIG. 1 and FIG. 2, reference number 10 denotes an electroacoustic transducer according to Embodiment 1. Reference numbers 11 and 12 denote a pair of magnet plates that are formed like a disk and are disposed parallel to each other. Supporting portion insertion holes 11*a* and 12*a* are provided at the center of the magnet plates 11 and 12. An acoustic diaphragm 13 is disposed at the intermediate portion between the magnet plates 11 and 12. A supporting portion insertion hole 13*a* is provided at the center of the acoustic diaphragm 13. A spiral conductor 14 is formed on the acoustic diaphragm 13. Small magnets 15 constitute the magnet plates 11 and 12 and are made of permanent magnets such as ferrite magnets, etc. Acoustic pores 16 are formed between the small magnets 15 adjacent to each other. A junction 16*a* fixes small magnets 15 secured between respective rows of the small magnets 15 or at the inner circumferential edge side of the innermost side row. Reference number 17 denotes a terminal portion of the conductor 14. A supporting portion 18*a* supports and fixes the respectively disposed magnet plates 11 and 12 parallel to each other in the supporting portion insertion hole 11*a* and 12*a* of the magnet plates 11 and 12, and a supporting portion 18*b* supports and fixes the respectively disposed magnet plates 11 and 12 parallel to each other at the outer circumferential portion of the magnet plates 11 and 12. An edge portion 19 resiliently couples the acoustic diaphragm 13 to the supporting portions 18*a* and 18*b* and has a suspension function. A lead wire 19*a* is connected to the conductor 14.

The acoustic diaphragm 13 is disposed, as shown in FIG. 2, at an intermediate portion between the magnet plates 11 and 12 that are connected via the edge portion 19 between the columnar supporting portion 18*a* disposed at the central side and a cylindrical supporting portion 18*b* disposed at the outer circumferential side and are provided parallel to each other.

The supporting portions 18*a* and 18*b* are composed of a non-magnetic body such as a synthetic resin, etc., so as to support repulsion forces of the two magnet plates 11 and 12 in which the same poles thereof are disposed opposite to each other.

In addition, the terminal portion 17 for which a drive current is supplied from outside is connected to both ends of the conductor 14 spirally formed via the lead wire 19*a* and is attached to the supporting portion 18*a* at the center side and the supporting portion 18*b* at the outer circumferential side.

The magnet plates 11 and 12 formed like a disk or a ring are further formed by concentrically arranging the small magnets 15 that respectively become partial areas, and respective rows of the small magnets 15 are fixed by the junction 16*a* composed of a synthetic resin such as polycarbonate, polyimide, etc.

The small magnets 15 are disposed and fixed at prescribed positions row by row, by coating an adhesive agent to the junctions 16*a*, in order from the innermost row. However, the small magnets 15 may be directly adhered between respective rows without any junction 16*a* or may be connected by injecting and hardening a resin between the respective rows.

Gaps brought about between adjacent small magnets 15 may directly be used as the acoustic pores 16.

The respective N and S poles of the small magnets 15 are magnetized so as to be set to an angle to the vibration plane of the acoustic diaphragm 13 by applying a simulation method, etc., described later, so that contribution to the effective operating magnetic flux density with respect to the conductor 14 of the acoustic diaphragm 13 is maximized.

Figure 3A:
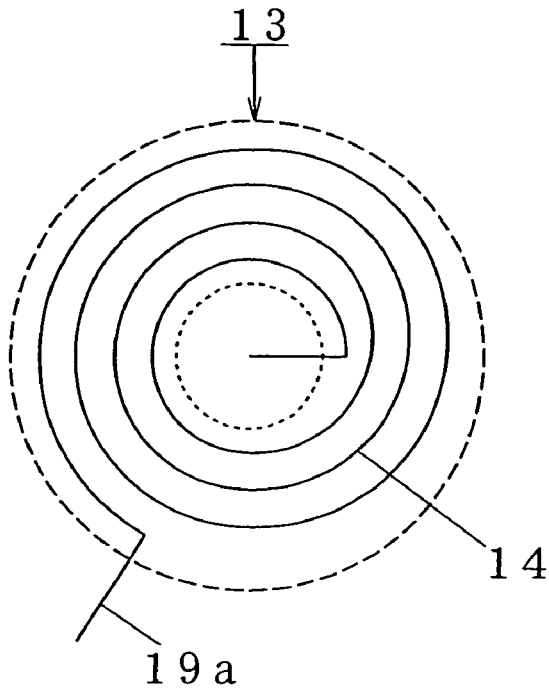
FIG. 3A is a plan view showing the major parts of an acoustic diaphragm in an electroacoustic transducer.
Figure 3B:
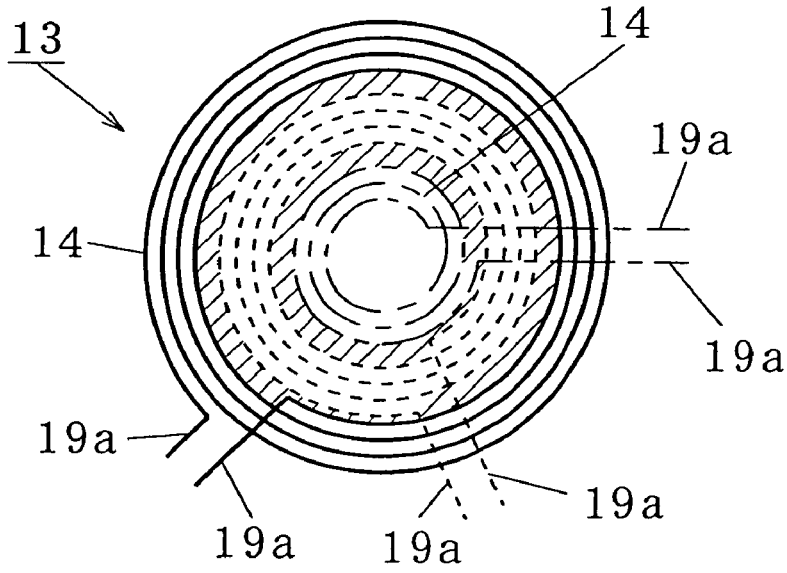
FIG. 3B is a plan view showing the major parts of a modified version of the acoustic diaphragm in an electroacoustic transducer.

FIG. 3A is a plan view showing the major parts of an acoustic diaphragm, in which a conductor is spirally formed, disposed at the intermediate portion between the magnet plates, and FIG. 3B is a plan view showing the major parts of a modified version of the acoustic diaphragm.

A thin ring-shaped acoustic diaphragm 13 is connected to the edge portion (not illustrated) that is resiliently coupled at the outer circumferential edge side and the inner circumferential edge side, and is supported by the supporting portions 18*a* and 18*b* in FIG. 2 via the edge portion. The conductor 14 made of aluminum or copper, etc., is spirally formed on the surface of the acoustic diaphragm 13 by means of deposition, plating or etching, etc.

The acoustic diaphragm 13 is constructed by spirally forming a wire-like conductor 14 on one side or both sides of a non-magnetic thin film of a synthetic resin, etc., which is formed like a disk or a ring. The spirally formed conductor 14 has a function equivalent to a voice coil.

The acoustic diaphragm 13 is placed in a magnetic field having a prescribed distribution of effective operating magnetic flux densities, and integrally vibrates the entirety thereof by generating a drive force resulting from an electromagnetic force on the entire surface of the acoustic diaphragm 13 due to the drive current that flows to the conductor 14 in a speaker, headphone, etc. In addition, the acoustic diaphragm 13 is vibrated by acoustic waves in a microphone, etc., and electromotive forces generated in the conductor 14 are made into electric signals.

In FIG. 3A and FIG. 3B, for simplification of the description, only a limited number of windings of the conductor 14 are illustrated, wherein the distribution density is low. However, the conductor 14 is disposed on almost the entire surface of the acoustic diaphragm 13 by increasing the number of windings and widening the width thereof, thereby increasing the distribution density, wherein the acoustic diaphragm 13 will be able to further integrally vibrate. Also, it is possible to improve the converting efficiency of energy by increasing the distribution density of the conductor 14.

Also, the acoustic diaphragm 13 may be such that a conductor 14 is placed between two non-magnetic thin films made of synthetic resin, etc., and such a type having an insulated conductor 14 spirally connected and the entirety thereof formed to be like a disk or a ring, which does not have a non-magnetic thin film may be used as the acoustic diaphragm 13.

Herein, by using a wide rectangular wire of high oblateness as the spirally formed conductor 14, it is possible to lower the electric impedance with the number of windings reduced.

Also, as shown in the modified version in FIG. 3B, it is possible to separately wind the conductor 14 in the form of a plurality of concentric blocks, whereby it is possible to improve the frequency characteristics of the electroacoustic transducer 10 by respectively varying, block by block, the diameter of wires and the number of windings, stiffness of a portion of connecting the respective blocks, and stiffness of a junction material between coils and separately using the blocks per frequency band.

Further, it is possible to control the amplitude of the respective blocks by varying the intensity of the drive current block by block.

In addition, where electric signals are digital signals such as PCM (Pulse Code Modulation signals), if an area per block is determined so that an output corresponding to respective bits is generated by dividing the pattern of the conductor 14 into blocks equivalent to the number of bits, the electroacoustic transducer may be used as a speaker for digital signals.

Figure 4:
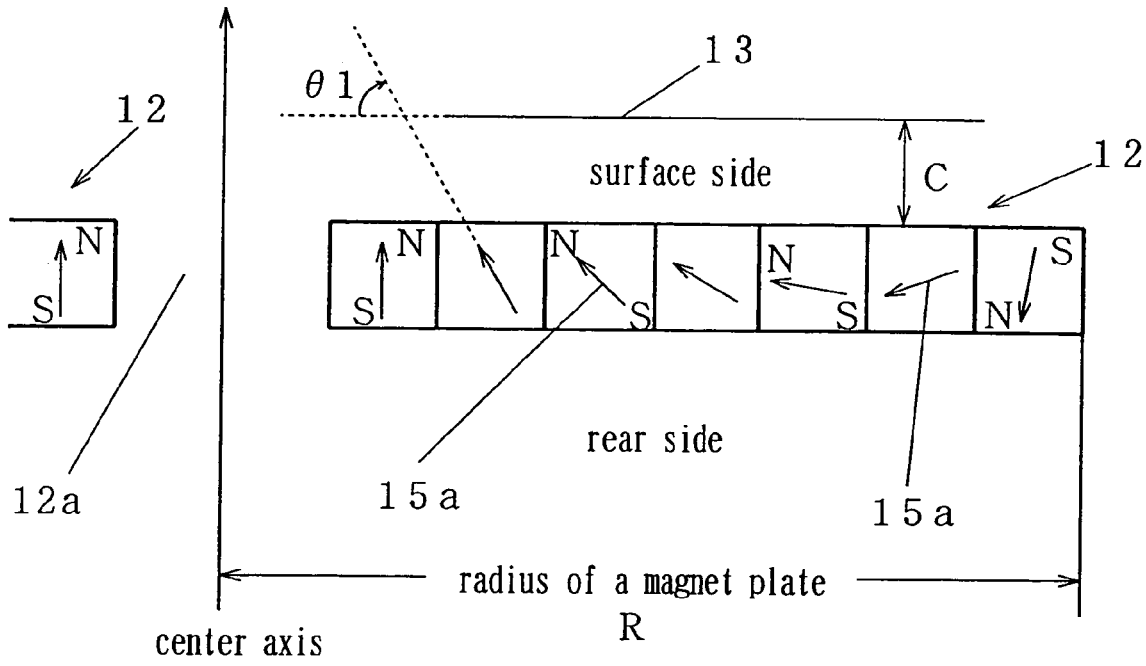
FIG. 4 is an exemplary view of a magnetization pattern of a magnet plate in an electroacoustic transducer according to Embodiment 1.

FIG. 4 is an exemplary view showing the pattern of a magnetization angle of small magnets 15 that become respective partial areas of the magnet plates 11 and 12 in the electroacoustic transducer 10 according to Embodiment 1.

In FIG. 4, reference number 12 denotes a magnet plate. A magnetization vector 15*a* corresponds to the magnetization direction of the small magnets 15 that become respective partial areas of the magnet plates 11 and 12. Also, although, in the magnetization vector 15*a*, the direction from the S pole to the N pole in the small magnets 15 is made into the positive vector direction, the characteristics of the electroacoustic transducer 10 are the same even if the entire S and N poles in the magnet plates 11 and 12 are inverted.

As shown in FIG. 4, it is assumed that the side where the magnetization vector 15*a* at the central portion side crosses the center axes of the magnet plates 11 and 12 is made into the surface side of the magnet plates 11 and 12, and an angle θ1 formed by the magnetization vector 15*a* with respect to the vibration plane of the acoustic diaphragm 13 is made into a magnetization angle in the positive direction. Since the effective operating magnetic flux density on the surface side is made higher than that on the rear side, the surface sides of the magnet plates 11 and 12 are oriented to the acoustic diaphragm 13 when using it.

The two magnet plates 11 and 12 each having the same shape and magnetization pattern are opposed to each other at the surface sides thereof with the positions of the outer circumferential edge portions thereof aligned, and are attached to the supporting portions 18*a* and 18*b* so as to become parallel to the acoustic diaphragm 13.

In the electroacoustic transducer 10, the magnetization intensity in the respective small magnets 15 (partial areas) of the magnet plates 11 and 12 is maximized. Also, with respect to the magnetization vector 15*a* of the respective small magnets 15, a component parallel to the vibration plane of the acoustic diaphragm 13 is in the radius direction of the magnet plates 11 and 12, and angles θ1 with respect to the vibration plane of the acoustic diaphragm 13 are distributed in the pattern as shown in FIG. 4 with respect to the radius direction of the magnet plates 11 and 12.

The respective angles θ1 are set to angles by which contribution of the effective operating magnetic flux with respect to the conductor 14 of the acoustic diaphragm 13 is maximized. That is, a magnetization angle is obtained, at which the ratio U/V (effective operating magnetic flux ratio) between a value (U) obtained by adding up the effective operating magnetic flux in the conductor 14 by the area of the conductor 14 and the total cubic volume (V) of the magnet plates 11 and 12 is maximized and the utilization efficiency of magnetic fluxes is made most satisfactory.

Herein, the angles θ1 of the magnetization vector 15*a* are made different from each other per ring row area that becomes a concentrically circular area and is formed of an aggregate of small magnets 15 disposed at each position of the same radius.

A pattern of such angles θ1 can be established through simulation by a computer using, for example, the present embodiment as a model.

If an attempt is made to obtain the pattern of angles θ1 by actually measuring the magnetic flux densities formed by the magnet plates, it is necessary to repeat trial and error while varying the magnetization angles of the magnet plates, wherein it is difficult to prepare magnet plates per magnetization angle varied. Also, in measurement of the magnetic flux densities, no accurate data can be obtained since errors are produced, resulting from differences in the positions of measurement at a magnetic sensor portion of a gaussmeter, angles with respect to the surfaces of the magnet plates, and angles, etc., of the magnet plates with respect to the radius direction.

An analysis technique was employed by the finite element method in the simulation program, and the Biot-Savart Law was employed in a calculation expression of a magnetic field and a magnetic flux density.

Since the Biot-Savart Law defines the relational expression between a current and a magnetic field formed by the current, a distribution of magnetic fields formed by magnetized magnets was achieved by the magnetic fields formed by a current in the program to enable the calculation.

Respective partial areas in the magnet plates 11 and 12 were made into data in which the areas are divided into further smaller elements, in order to make a calculation by the finite element method.

In order to express the state of magnetization in the divided elements in accordance with the intensity of a current flowing in a circular coil, a circular coil was assumed and disposed per element. The center axis of the circular coil is made coincident with the magnetization direction of the element, and the diameter thereof was made equal to or smaller than the size of the element.

In the program, the above-described circular coil was equally divided, and the direction, intensity and coordinates of the current at the respective divided positions M were made into data. And, such circular coils were assumed so as to correspond to all the elements. Here, respective data of the direction, intensity and coordinates of the current at all the divided respective positions M were generated and were established as data of the program.

As described above, the state of magnetization of the respective elements were achieved by the distribution of currents at the respective positions M, wherein, by calculating and adding up the effective operating magnetic fluxes obtained by the respective currents contributing to the conductor 14 of the acoustic diaphragm 13 in accordance with the Biot-Savart Law, the distribution of the effective operating magnetic flux density brought about by the magnet plates 11 and 12 was analyzed.

The following expression is a relational expression between the currents at the positions M and the magnetic flux density (dB) using the Biot-Savart Law.

$$dB=k\cdot\mu\cdot i\cdot dl\cdot\sin\theta/(4\pi\cdot r^2)$$

where dB is a magnetic flux density to be obtained, μ is magnetic permeability at the position where dB is obtained, dl is a length obtained by dividing the circular coil, i is an intensity of a current at the respective positions M where the circular coil is divided, θ is an angle formed by a line from the position M to the position where the magnetic flux density dB is obtained and by the direction of the current at the positions M, π is the circular constant (pi), and r is a distance between the positions M and the position where the magnetic flux density dB is obtained.

And k is an aggregate of a coefficient to obtain the state of magnetization of magnet plates by converting it to the state of currents, which is a feature of the present simulation, and a coefficient regarding the dividing method of elements in the finite element method and distribution of the positions M, etc.

Since the circular coil is equally divided, the length dl is constant. Although the intensity i of the current becomes a constant value by element of the finite element method, that is, a circular coil, the intensities i of all the currents become the same value where the intensity of magnetization of the entirety of the magnet plates is constant.

In the present embodiment, since the intensities of magnetization of the entirety of the magnet plates 11 and 12 are made constant, it is possible to establish a constant K which is caused to aggregate as described below.

$$K=k\cdot\mu\cdot i\cdot dl/4\pi$$

By setting such a constant K, the expression for obtaining the above-described magnet density dB may be determined with a variable set only to an angle θ and distance r.

$$dB=K\cdot\sin\theta/r^2$$

Also, herein, since the magnetic flux dB is an absolute value, the effective operating magnetic flux is obtained by calculation, which is parallel to the vibration plane of the acoustic diaphragm 13 and is in the radius direction, on the basis of the calculated values of the magnetic flux density dB at respective positions of the acoustic diaphragm 13. Further, the intensity of the magnetic field may be obtained by dB/μ.

With respect to the value of coefficient K in the present simulation, it is established by inverse calculation using the above-described calculation expression based on the actually measured value of the magnetic flux densities by the magnet plate used for an experiment.

Thus, the above-described calculation expression is incorporated into the simulation program, wherein by adding up the effective operating magnetic flux contributing to the conductor 14 of the acoustic diaphragm 13 in connection with the currents at all the positions M, the distribution of the effective operating magnetic flux density brought about by the magnet plates 11 and 12 was obtained.

In addition, where a magnet material such as a rare-earth magnet like neodymium, etc., and a ferrite magnet was used, the demagnetization curve of which can be approximated by a straight line, since the simulation result can be made considerably close to the actually measured value, a rare-earth magnet or a ferrite magnet was used as a material for magnet plates for a prototype and experiments.

Magnet plates according to Embodiment 1 were produced by combining a number of small magnets in order to make the patterning of magnetization to be easily reproduced. A measurement error was produced in the measurement of the magnetic flux density aiming at such magnet plates, and at the same time, unevenness in the distribution of the magnetic flux density results from small magnets, which are partial areas, have considerable sizes and gaps exist between the small magnets. Therefore, simulations were repeated to verify the value on the basis of the magnetic flux densities at parts having only slight unevenness in the magnetic flux by the magnet plates used for the experiment and data of the parts which are characteristic in terms of the positions where the magnetic flux direction is inverted. And, the number of divisions of elements, coordinates, and coefficients, etc., were adjusted in the finite element method in the simulation program.

The simulation was carried out part by part in the form of ring-shaped areas, that is, aggregates of small magnets 15 located at the positions having the same radius. Calculation was carried out with the magnetization angle data varied degree by degree in the ring-shaped areas, wherein the magnetization angle at which the effective operating magnetic flux ratio is maximized is made into magnetization angle θ1 of partial areas that constitutes ring-shaped areas.

Also, if it is assumed that calculations are carried out with the size of small magnets 15 made into partial areas as it is where the general θ1 pattern is investigated by simulations, since the partial areas are large wherein it is difficult to exactly grasp the features thereof, simulations were carried out with the assumption that the partial areas are divided into further smaller divisions.

By these trial calculations, the following features regarding the magnetization vector 15*a* were found.

The pattern of a change in the magnetization vector 15*a* to maximize the effective operating magnetic flux contributing to the conductor 14 of the acoustic diaphragm 13 became such that, excluding a case where the direction of the magnetization vector 15*a* becomes perpendicular to the vibration plane, that is, where the magnetization angle becomes 90 degrees, a component of the magnetization vector 15*a*, which is parallel to the vibration plane of the acoustic diaphragm 13, always is in the radius direction of the magnet plates 11 and 12. And, with respect to a change in the position in the radius direction from the center axis side of the magnet plates 11 and 12 to the outer circumferential side thereof, it was found that the magnetization vector 15*a* has a distribution by which the angle θ1 produced by the acoustic diaphragm 13 with respect to the vibration plane is always made to decrease, that is, the magnetization vector 15*a* is caused to rotate in one direction.

Further, the distribution of the magnetization vectors 15*a* was not the distribution so as to form N and S poles in which the entirety of the magnet plates 11 and 12 are integrated and is caused to aggregate, but a distribution so as to form magnetic poles in which the magnetic vectors 15*a* of small magnets 15, which are respective partial areas, are different and independent from each other.

Hereinafter, in order to maximize the effective operating magnetic flux contributing to the conductor 14 of the acoustic diaphragm 13, a general description is given of the distribution state of the angle θ1 established by the magnetization vector 15*a* and the vibration plane of the acoustic diaphragm 13.

Since the pattern of the angle θ1 varies due to spacing C between the magnet plates 11 and 12 and the acoustic diaphragm 13 and the installation range of a conductor 14 formed on the acoustic diaphragm 13, herein, a description is given in a state where the installation range is limited to a range of the magnet plates 11 and 12 corresponding to the range surrounded by the inner diameter and outer diameter of the conductor 14 on the acoustic diaphragm 13.

The angle θ1 is maximized at the center axis side in the above-described range, and the maximum value becomes +90 degrees in respective setting conditions of the angle. The angle θ1 always decreases with respect to a change in the position to the outer circumferential side in the radius direction, and generally becomes zero degrees at the position of 80 through 90% of the outer diameter in the above-described range. Further, the angle θ1 continuously decreases to a negative value with respect to the change in the position toward the outer circumferential side and is minimized at the outer circumferential edge side in the above-described range, wherein the minimum value is approximately −70 degrees in respective setting conditions of the angle.

As a method for magnetizing the magnet plates 11 and 12 having such a magnetization angle distribution, a spirally wound magnetizing coil is disposed parallel to the planes on the surface sides of disk-shaped magnet materials and a DC magnetizing current is caused to flow thereinto, it is possible to form a distribution of a similar magnetization angle with respect to the magnetic material. And, by varying the inner diameter and outer diameter of the magnetizing coil, it is possible to respectively adjust the angles of magnetization in partial areas distributed in the magnetic material.

Further, by disposing a magnetizing coil on a plane, which is the rear side of a disk-shaped magnetic material, parallel to the plane as on the surface side thereof and causing a magnetizing current so that it is opposed to the magnetic pole on the surface side coil, it is possible to form a magnetic distribution in which the magnetizing directions of all the partial areas are made into almost the radius directions with respect to the magnetic material. Further, it is possible to adjust the angle of magnetization, which is formed by the magnetizing current on the surface side, by making small the magnetizing current or changing the inner diameter and outer diameter with respect to the rear side coil.

Therefore, if such a method is used, it is possible that the magnet plates are directly magnetized so that the entire magnetic material formed like a disk is made into a distribution state having a prescribed magnetization angle. However, since the method requires a very intensive magnetizing current in order to intensively magnetize the magnet plates, such a method is employed in the present embodiment, in which small magnets 15 individually magnetized in advance are used, and are combined together via the junction 16*a*.

Herein, a rare-earth magnet such as a neodymium-based magnet, etc., and a magnet such as a ferrite magnet whose demagnetization curve can be approximated by a straight line are used as the magnet plates 11 and 12, wherein the entire thickness B is 7 mm, radius R is 48 mm, and spacing H between the magnet plates 11 and 12 is 6 mm.

In addition, the entirety of the magnet plates 11 and 12 are composed by disposing 486 small magnets 15, whose size is 5.5 mm long×2 mm wide×7 mm high, concentrically in seven rows. The width of one row is 5.5 mm. The width of the junction 16*a* that becomes spacing between the rows is 0.5 mm, and the inner diameter of the innermost row is 13 mm while the outer diameter of the outermost row is 96 mm.

The inner diameter of the conductor 14 of the acoustic diaphragm 13 was determined to be 26 mm, and the outer diameter thereof was determined to be 86 mm, wherein the effective operating magnetic flux contributing to the ring-shaped portion surrounded by the inner diameter and outer diameter was calculated. Where angles (angles θ1 in FIG. 4) established by the magnetization vector and the vibration plane of the acoustic diaphragm 13 in order to maximize the value were obtained radius by radius at every 3 mm spacing, the angles were 98 degrees when the radius was 3 mm, 97 degrees when the radius was 6 mm, 92 degrees when the radius was 9 mm, 78 degrees when the radius was 12 mm, 62 degrees when the radius was 15 mm, 51 degrees when the radius was 18 mm, 44 degrees when the radius was 21 mm, 38 degrees when the radius was 24 mm, 31 degrees when the radius was 27 mm, 23 degrees when the radius was 30 mm, 14 degrees when the radius was 33 mm, 0 degrees when the radius was 36 mm, −20 degrees when the radius was 39 mm, −49 degrees when the radius was 42 mm, −84 degrees when the radius was 45 mm, and −99 degrees when the radius was 48 mm.

Also, where the magnetization directions of partial areas in the embodiment, that is, angles θ1 of the magnetization vectors 15*a* were obtained row by row of the small magnets 15, the angles θ1 are 88 degrees for the first row, 62 degrees for the second row, 44 degrees for the third row, 31 degrees for the fourth row, 12 degrees for the fifth row, −23 degrees for the sixth row, and −78 degrees for the seventh row in order from the innermost row. Therefore, in the present embodiment, the magnetization angles were established to almost the same angles as above in the embodiment.

The narrower the width of the respective rows is made and the smaller the partial areas of the magnet plates 11 and 12 are made, the further the unevenness of the distribution of the effective operating magnetic flux density formed on the acoustic diaphragm 13 can be reduced. Therefore, although it is idealistic that the magnetization direction is continuously optimized without any break with respect to the distance from the center axis, Embodiment 1 employs 7 rows, taking easiness in production into consideration.

According to the result of such a construction, the cubic volume ratio (P:Q) between the total cubic volume (P) of all the small magnets 15 in the magnet plates 11 and 12 and the total cubic volume (Q) of parts that become spacing A between the small magnets 15 became 3:1. Also, where an anisotropic Sr ferrite magnet is used as a material of the small magnets 15, the maximum value of the effective operating magnetic flux density in the conductor 14 formed on the acoustic diaphragm 13 was 1800 G (gauss), and the average value in the installation range was 1350 G.

In connection with the electroacoustic transducer 10 according to Embodiment 1, which was constructed as described above, a description is given below of the features thereof.

Figure 5A:
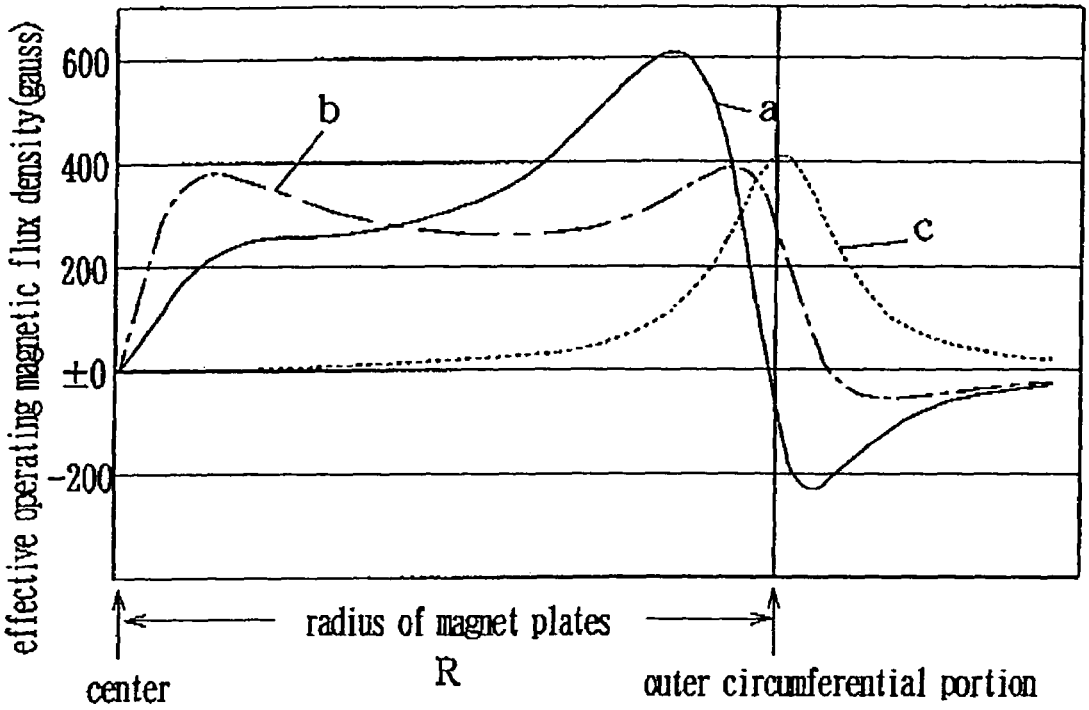
FIG. 5A is a graph showing effective operating magnetic flux densities with respect to the radius direction of an acoustic diaphragm.

FIG. 5A is a graph comparing the effective operating magnetic flux densities at respective positions from the center axis side of the acoustic diaphragm to the vicinity of the outer circumferential portion thereof per set condition of the magnet plates.

It is possible to set such data by carrying out simulations using a computer.

In the simulations, using as a model a magnet plate for experiment, which is prepared by a combination of a number of small magnets, data pertaining to the direction and intensity of magnetization in respective partial areas of the magnet plate are incorporated into the program, and the intensity of a magnetic field contributing to the conductor of the acoustic diaphragm from respective positions of the magnet plate is calculated by the Biot-Savart Law and is analyzed by the finite element method.

When measuring the magnetic flux density of the actually assembled magnet plate, not only does an error arise in the measuring using the gaussmeter, but also it becomes difficult to grasp the features pertaining to the basic distribution since the measurement data receives influences of the magnetic field with respect to the thickness direction of the magnet plate and becomes a value synthesized in the thickness direction.

Therefore, simulations were repeated to verify the value on the basis of the magnetic flux densities at parts having only slight unevenness in the magnetic flux by the magnet plates used for the experiment and data of the parts which are characteristic in terms of the positions where the magnetic flux direction is inverted. And, the number of divisions of elements, coordinates, and coefficients, etc., were adjusted in the finite element method in the simulation program.

Thus, in the simulation program that was adjusted so that the error is minimized, data are prepared by dividing the small magnets, which becomes the minimum unit, into further smaller partial areas, and the thickness of the magnet plate is changed to be thin to such a degree that is not influenced by the thickness, that is, the effective operating magnetic flux ratio (U/V) is not changed even if the thickness is changed, and simulations are carried out again, whereby the distribution data of the effective operating magnetic flux densities shown in FIG. 5A were obtained.

In FIG. 5A, in the electroacoustic transducer as in the Embodiment 1, "a" shows a distribution of the effective operating magnetic flux densities with respect to the radius direction of the acoustic diaphragm in the case where the ratio (C/R) between the distance (C) from the magnet plates to the acoustic diaphragm and the radius (R) of the magnet plates is 0.1 based on the assumption of two neodymium magnet plates opposed to each other, which is magnetized at a prescribed angle at which the contribution of the effective operating magnetic flux with respect to the conductor of the acoustic diaphragm is maximized. Also, as the two magnet plates, those the entirety of which is not provided with any acoustic pores composed only of the magnet and that are thin disk-shaped to have a thickness, which is 1% of the radius R, so that the effective operating magnetic flux ratio is not influenced by the thickness are assumed. In addition, the size of the magnet plates at the outer circumferential portion position, which is described in the abscissa of the graph of FIG. 5A, may be any figure as long as the figure meets the above-described condition.

For example, in neodymium magnet plates whose radius R is 50 mm, the thickness is made to be 0.5 mm, and it is possible to know, on the basis of the graph, the effective operating magnetic flux density at respective positions of the acoustic diaphragm separated by 5 mm from the magnet plates. Further, where the thickness of the magnet plates is set to ten times the above (that is, 5 mm), it is possible to obtain the effective operating magnetic flux density by making the figure in the graph approximately larger by approximately eight times although the distribution profile slightly changes.

In addition, "c" shows a distribution of the effective operating magnetic flux density where all the conditions are identical to those in the case of "a" except the magnetization direction of the magnet plates where disk-shaped magnet plates that are magnetized in the perpendicular direction with respect to the vibration plane of the acoustic diaphragm are used.

Herein, in a case where thin band-shaped magnets that are magnetized in the perpendicular direction with respect to the vibration plane of the acoustic diaphragm are assumed to be used, a distribution almost similar to the distribution "c" can be obtained from the coordinate system where the band-shaped width is regarded as the diameter of the disk.

Although there are many cases where a plurality of magnets are combined when using a magnet plate magnetized in the perpendicular direction with respect to the acoustic diaphragm as in prior arts, in the case of "c," it is possible to grasp the distribution state by the magnet that becomes a component thereof.

Figure 5B:
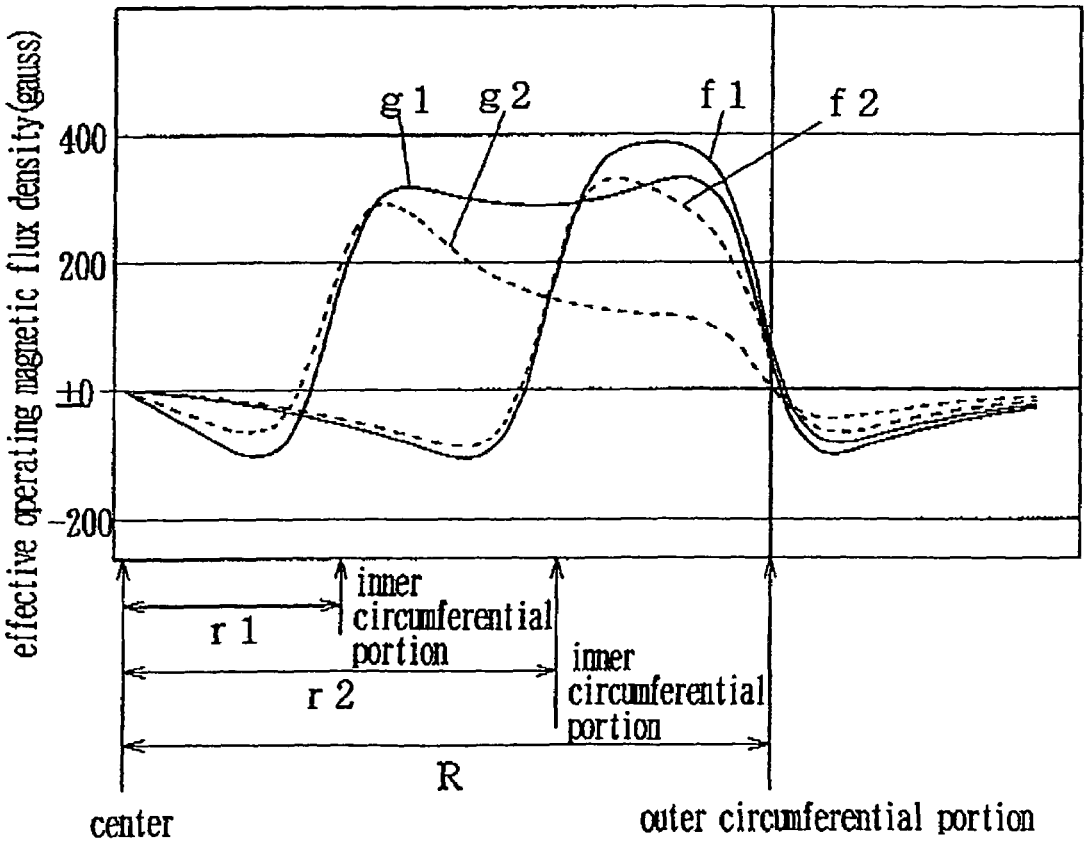
FIG. 5B is a graph showing effective operating magnetic flux densities with respect to the radius direction of an acoustic diaphragm.

Also, the ratio (C/R) is based on the condition that, taking into consideration the effective operating magnetic flux ratio, distribution state of the effective operating magnetic flux, radius and amplitude of the acoustic diaphragm, etc., on the basis of the features described later, which pertain to the distance C and radius R of the magnet plates, 0.1 is established as an example of the ratio (C/R) at which a substantially effective operating magnetic flux ratio becomes large, and the distributions of the effective operating magnetic flux densities by respective magnet plates in FIG. 5A and FIG. 5B are compared.

Where the distributions of the effective operating magnetic flux densities as shown in FIG. 5A are utilized in an electroacoustic transducer, the areas of effective operating magnetic fluxes contributing to vibrations become ring-shaped. In the distribution of effective operating magnetic flux densities in "a," the ratio between the value (U) obtained by adding up the effective operating magnetic flux by the ring-shaped area and the total cubic volume (V) of the magnet, that is, the utilization ratio of magnetic fluxes using the effective operating magnetic flux ratio shown in terms of U/V becomes a value which is larger by 2 through 2.5 times than in the case of the distribution at "c."

Although it is not possible to simply compare the present embodiment with the prior arts since the configuration methods of magnet plates differ from each other, thus, in the case of using a magnet plate magnetized at a prescribed angle with respect to the vibration plane of the acoustic diaphragm in respective partial areas, it is found that highly effective operating magnetic flux densities can be secured at a considerably wide region in an aggregate area as shown in the distribution at "a" in FIG. 5A in comparison to the case of using a disk-shaped magnet plate or band-shaped magnet, which is magnetized in the perpendicular direction with respect to the vibration plane.

In addition, by carrying out simulations under various setting conditions, it was found that the following correlation exists among the distance C from the magnet plate to the acoustic diaphragm, radius R of the magnet plate, effective operating magnetic flux ratio, distribution state of effective operating magnetic fluxes, etc.

It is found that the distribution profile of effective magnetic operating magnetic flux densities in the acoustic diaphragm as shown in FIG. 5A is determined by the ratio (C/R) regardless of the degree of distance C and radius R. Therefore, where the ratio (C/R) is common, the distribution profile of the effective operating magnetic flux densities becomes the same even if the values of the distance C or radius R change.

Further, the effective operating magnetic flux ratio (the effective operating magnetic flux per unit volume of a magnet plate) of the acoustic diaphragm is expressed by the ratio (U/V) of the value (U) obtained by adding up the effective operating magnetic flux in a conductor of the acoustic diaphragm by the area of the conductor and the total cubic volume (V) of the magnet plate.

It was found that the effective operating magnetic flux ratio (U/V) is almost inversely proportional to the values of distance (C) and radius (R) where the ratio (C/R) is made constant. For example, where the distance C and radius R are made one half (that is, ½ times), the effective operating magnetic flux ratio is increased approximately two times although the distribution profile of the effective operating magnetic flux densities in the acoustic diaphragm does not change.

In addition, since the converting efficiency of energy is proportional to the square of the magnetic flux density in a electrodynamic type electroacoustic transducer as in the invention, with respect to the effective operating magnetic flux density and effective operating magnetic flux ratio in the conductor of the acoustic diaphragm, the converting efficiency is influenced in proportion to approximately the square thereof. For example, where the distance C and radius R are made one half (½ times) and the effective operating magnetic flux ratio is made two times, the converting efficiency is increased to the square thereof, that is, approximately four times.

Next, the shorter the distance C to the acoustic diaphragm is, the further the effective operating magnetic flux ratio (U/V) is increased. However, in a state where the distance C is fixed, if the radius R of the magnet plate is set so that, in a thin disk-shaped magnet plate not influenced by the thickness, the ratio (C/R) is caused to enter a range from approximately 0.08 to 0.4, it is possible to increase the utilization efficiency of magnetic fluxes in a state where both the effective operating magnetic flux density and the effective operating magnetic flux ratio are almost maximized.

Here, the thin magnet plate not influenced by the thickness is a magnet plate that has a thickness t, by calculating the effective operating magnetic flux ratio Z of the thickness t of the magnet plate at which the difference (|Z−Z0|) between the limit value Z0 of the effective operating magnetic flux ratio as the reference when the thickness is converged to zero and the effective operating magnetic flux ratio Z become less than 3% of Z0. For example, it corresponds to a magnet plate the thickness t of which becomes approximately 1% or less of the radius R. With such a magnet plate, it is possible for the error in the ratio (C/R), which is obtained by comparing the effective operating magnetic flux ratios as shown below, to be made smaller than 0.5%.

Although the effective operating magnetic flux ratio differs due to a distribution of magnetization angles in partial areas of a magnet plate, it is lowered the smaller the ratio (C/R) becomes less than 0.08 or the larger the ratio (C/R) becomes greater than 0.4. Therefore, in order to maintain a satisfactory effective operating magnetic flux ratio, it is preferable that the ratio (C/R) is set in such a range of 0.08 through 0.4.

In Embodiment 1, since the distance C is 3 mm and radius R is 48 mm, the ratio (C/R) becomes 0.0625. However, since the thickness of the magnet plates 11 and 12 is made 7 mm and is thicker than the thickness that is not influenced by the above-described thickness (0.5 mm which is approximately 1% of the radius 48 mm), the adequate range of the ratio (C/R) is different from that in the above-described case.

If the magnet plates are thick, a conversion value of the ratio (C/R) corresponding to the case where the thickness of the magnet plates is thin is obtained by comparing the thickness of the magnet plates with the simulation results where the thickness is made thin until the magnet plates are not influenced by the thickness.

That is, in simulations, a ratio (C/R) closest to the effective operating magnetic flux ratio of Embodiment 1, in which the magnet plates 11 and 12 whose effective operating magnetic flux ratio is a thickness of 7 mm are used, is obtained by varying the distance, C in a state where the radius R of the magnet plates having a thickness of 0.5 mm is made constant to be 48 mm. The obtained figure is made into the conversion value. Thus, in Embodiment 1 in which the thickness of the magnet plates 11 and 12 is 7 mm, approximately 0.12 is obtained as the conversion value corresponding to the ratio (C/R) where the magnet plates are not influenced by the above-described thickness.

Figure 6:
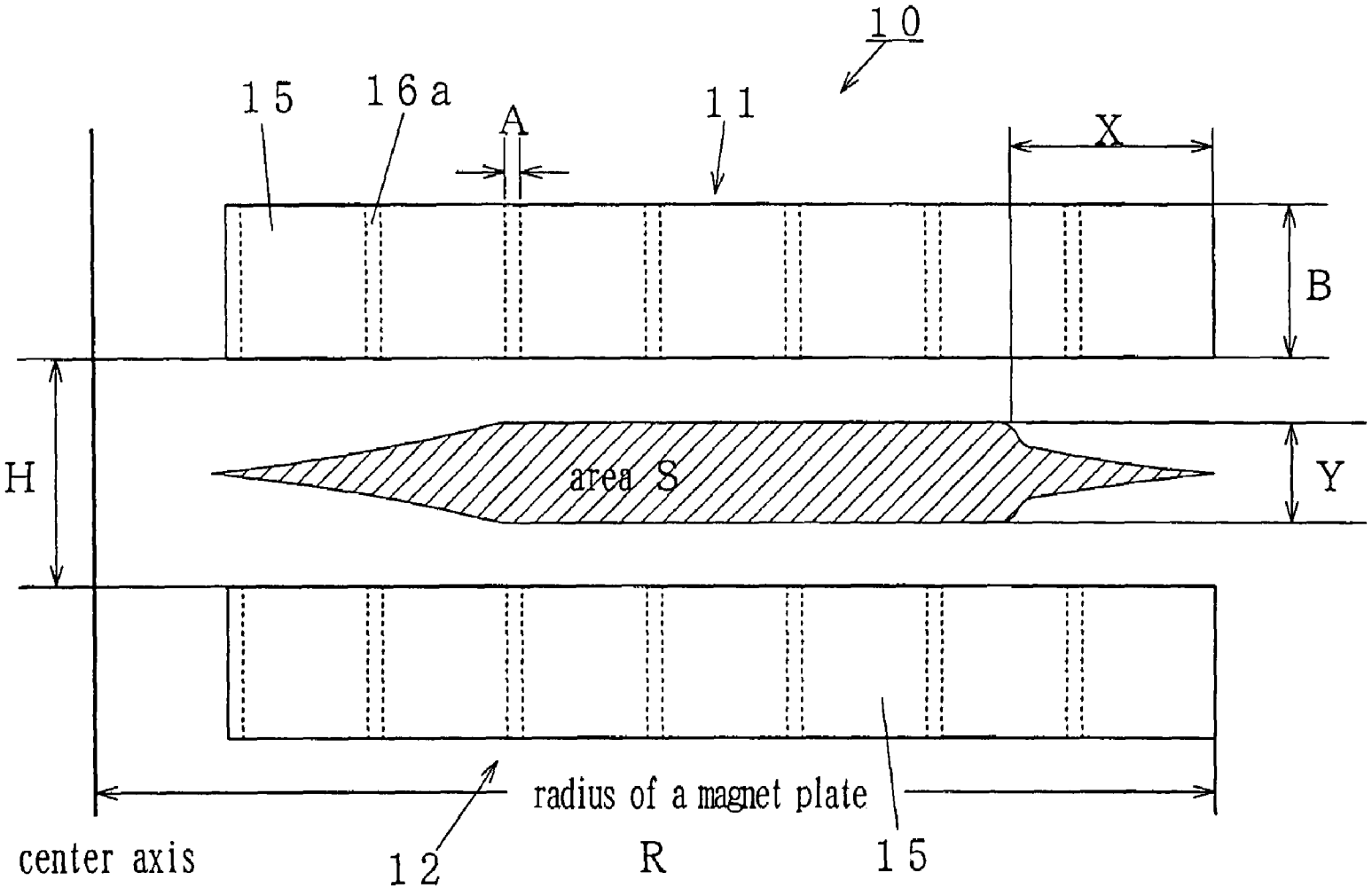
FIG. 6 is a distribution view of effective operating magnetic flux densities inside an electroacoustic transducer.

Using a diagonal line portion S, FIG. 6 shows a range in which a changes in the effective operating magnetic flux densities corresponding to the direction perpendicular to the vibration plane of the acoustic diaphragm 13, that is, the vibration direction, become 1% or less at respective positions from the center of the acoustic diaphragm to the vicinity of the outer circumferential portion thereof, using the effective operating magnetic flux density at the installation position of the acoustic diaphragm 13 as the reference.

Also, where change in the above-described density is obtained by actually measuring the magnetic density, in the measurement of the effective operating magnetic flux density using the gaussmeter, it is necessary to orient the direction of the magnetic sensor in the radius direction in a state where the direction of the magnetic sensor is made parallel to the vibration plane of the acoustic diaphragm 13. Therefore, unless the direction of the magnetic sensor is accurate, an error arises in the measurement value of the effective operating magnetic flux density. For example, if the direction of the magnetic sensor shifts by 1 degree from the direction parallel to the vibration plane of the acoustic diaphragm 13, an error of 1% or more on average arises, and if the direction of the magnetic sensor shifts by 8 degrees from the radius direction, an error of approximately 1% arises.

Accordingly, by carrying out simulation using the present embodiment as a model, no actual measurement using a gaussmeter is required, and the above-described errors can be removed. Also, the size and distribution state of respective spacings A between small magnets 15 which become acoustic pores 16, and spacing between the magnet plates 11 and 12 are varied to set combinations, and simulations for respective established combinations are carried out, whereby conditions for giving a uniform and adequate distribution of effective operating magnetic flux densities are obtained.

By investigating the distribution using such a method, it becomes possible to grasp an accurate distribution state of the effective operating magnetic flux densities with respect to an area (diagonal line portion S) having fewer changes in the effective operating magnetic flux densities with respect to the vibration direction based on the installation position of the acoustic diaphragm 13 as a reference as in FIG. 6, wherein the following can be understood. Also, since the profile of the diagonal line portion S is not fixed in accordance with the installation positions in the radius direction due to receipt of influences of the acoustic pores 16, a simulation program is prepared so that a value at which the conditions are deteriorated (that is, where the range of the diagonal line portion S is narrowed) at respective positions is synthesized, thereby obtaining the diagonal line portion S.

In FIG. 6, reference symbol Y denotes the height of a portion where the spacing between the upper and lower ends of the diagonal line portion S is almost maximized.

In order to drive the conductor 14 in an area having a slight change in the effective operating magnetic flux densities, it is necessary to determine the outer diameter of the conductor 14 by taking into consideration the range of the portion in which the height is Y. Therefore, distance X from the outer circumferential edge side of the magnet plates 11 and 12 to the outermost circumferential edge side of the portion where the height is Y becomes the basis of determining the outer diameter of the conductor 14. Based on simulation results, it is understood that the distance X is almost proportional to the spacing H between the magnet plates 11 and 12. That is, the distance X is lengthened almost in proportion to the degree of widening the spacing H between the magnet plates 11 and 12 while the range of the portion in which the height of the diagonal line portion S is Y is narrowed.

Next, with respect to the spacing A between small magnets 15, which is utilized as the acoustic pores 16 and junctions 16*a*, since the distribution of magnetic fields brought about from the magnet plates 11 and 12 by the size and disposing conditions of the small magnets 15 may vary, it is understood that the size and disposing conditions thereof influence the uniformity of the effective operating magnetic flux densities.

And, the size and distribution state of the spacings A become a large factor which determines the height Y. That is, it is understood that the smaller the spacings A is made and the more uniformly the spacings A are distributed in a concentric area, the larger the height Y of the area (diagonal line portion S) having only slight changes in the effective operating magnetic flux densities becomes.

In particular, if the acoustic pores 16 are made so thin and uniform that no influence is brought about with respect to changes in the effective operating magnetic flux densities, it is possible to make the height Y equal to the spacing H, wherein the height Y of the diagonal line portion S is maximized and almost the entirety between the magnet plates 11 and 12 can be made into an area having only a slight change in the effective operating magnetic flux densities.

Accordingly, in the embodiment, the width of the junction portions 16*a* is made narrow, and a number of acoustic pores 16 are uniformly and concentrically disposed on the magnet plates 11 and 12. And, with such a countermeasure, a decrease in a change of the effective operating magnetic flux densities will be achieved.

In the embodiment, nearly all the respective spacings A between adjacent small magnets 15 in the same row of the small magnets 15 are made 0.8 mm or less, and acoustic pores 16 are formed therein. However, the ratio (Y/H) of the height Y in the diagonal line portion S to the spacing H is approximately ⅓. That is, the spacing H between the magnet plates 11 and 12 is 6 mm, and the height Y is approximately ⅓ thereof, that is, 2 mm, wherein the range of approximately −1 mm through +1 mm from the installation position of the acoustic diaphragm 13 becomes an area in which a change in the effective operating magnetic flux densities is made to be 1% or less. In such an area, it is possible to vibrate the acoustic diaphragm 13 in a state of very low distortion.

Since an electroacoustic transducer 10 according to Embodiment 1 is constructed as described above, the following actions can be obtained.

(a) Since the magnetization directions in partial areas of the magnet plates 11 and 12 are established at a prescribed angle by which the contribution of the effective operating magnetic flux with respect to the conductor 14 of the respective acoustic diaphragm 13 is maximized with respect to the vibration plane of the acoustic diaphragm 13, it is possible to effectively generate components (effective operating magnetic fluxes) parallel to the vibration plane in the radius direction of the magnetic fluxes at the acoustic diaphragm 13.

(b) Since the directions of magnetization in the partial areas are, respectively, established at a prescribed angle with respect to the vibration plane of the acoustic diaphragm 13, it is possible to secure highly effective operating magnetic flux densities at a wide range in an aggregate area, whereby since the area of the conductor 14 can be continuously secured in a wide range in the thin and ring-shaped acoustic diaphragm 13, it becomes possible to generate a drive force resulting from an electromagnetic force on the entire surface of the acoustic diaphragm 13. Therefore, an electroacoustic transducer 10 such as an entire-surface-drive type plane speaker, which has less distortion and is excellent in transition characteristics, can be brought about.

(c) Since the directions of magnetization in respective partial areas of the magnet plates 11 and 12 are set at a prescribed angle with respect to the vibration plane of the acoustic diaphragm 13, a distribution having fewer changes can be obtained with respect to the effective operating magnetic flux densities at respective positions with respect to the vibration direction of the acoustic diaphragm 13 while securing the area of required effective operating magnetic flux densities in a wide range. Therefore, distortion resulting from a difference in the intensities of the effective operating magnetic flux densities with respect to the vibration direction of the acoustic diaphragm 13 can be controlled, and it is possible to maintain the quality of sounds generated in a speaker, headphone, etc., and electric signals converted from sounds in a microphone, etc., in a satisfactory state.

(d) Since a uniform distribution of the effective operating magnetic flux densities can be constructed in a wide range in the vibration direction, satisfactory sounds can be maintained where the amplitude of the acoustic diaphragm 13 is increased or where an error is generated more or less in the installation positions of the acoustic diaphragm 13.

(e) Since the small magnets 15 can be magnetized with the size and profile thereof turned up, limitation in production is only slight and productivity is excellent in comparison to a case where magnetization is directly applied onto a disk-shaped magnet material.

(f) Since magnet plates 11 and 12 can be prepared by only disposing small magnets having the same profile, magnetization angle and magnetization intensity row by row in respective partial areas, it is possible to construct intensive magnet plates 11 and 12 using an inexpensive standardized material.

(g) Since acoustic pores 16 are formed to permit acoustic waves to pass through between the small magnets 15, acoustic waves generated in the entire area of the acoustic diaphragm 13 in a speaker and headphone, etc., can be discharged without mutual interference therebetween. Also, it is possible to obtain electric signals having less distortion while reducing interference of sounds received from the outside in a microphone, etc., whereby it is possible to provide an electroacoustic transducer 10 such as a speaker and microphone, etc., which is excellent in sound quality.

(h) Since gaps between the small magnets 15 are used as the acoustic pores 16, the acoustic pores 16 can be formed only by aggregating the small magnets 15, wherein an electroacoustic transducer 10 can be simply formed with no drilling work required.

(i) Since the entire structure is symmetrical with respect to the vibration plane of the acoustic diaphragm 13, the structure can be made acoustically excellent with respect to vibrations of the acoustic diaphragm 13.

(Embodiment 2)

Figure 7A:
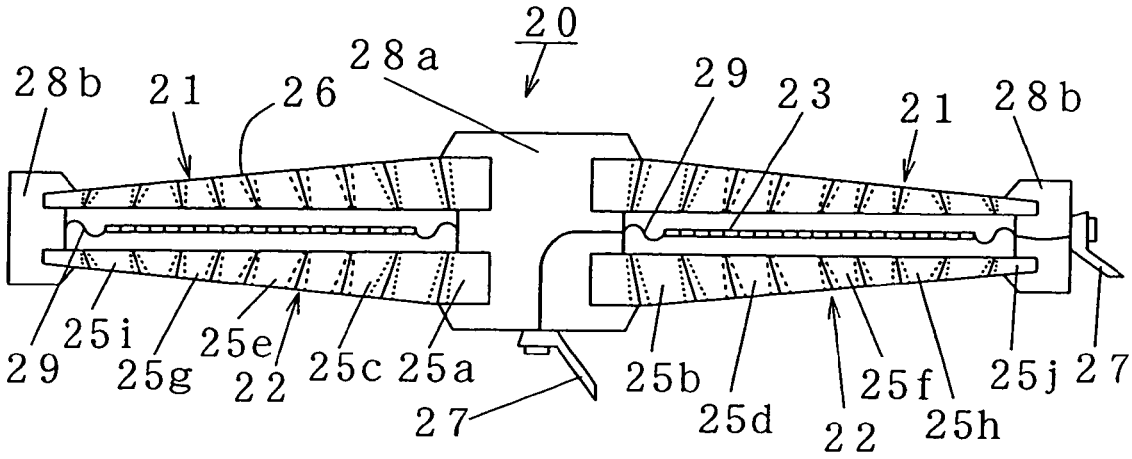
FIG. 7A is a sectional view showing the major parts of an electroacoustic transducer according to Embodiment 2.
Figure 7B:
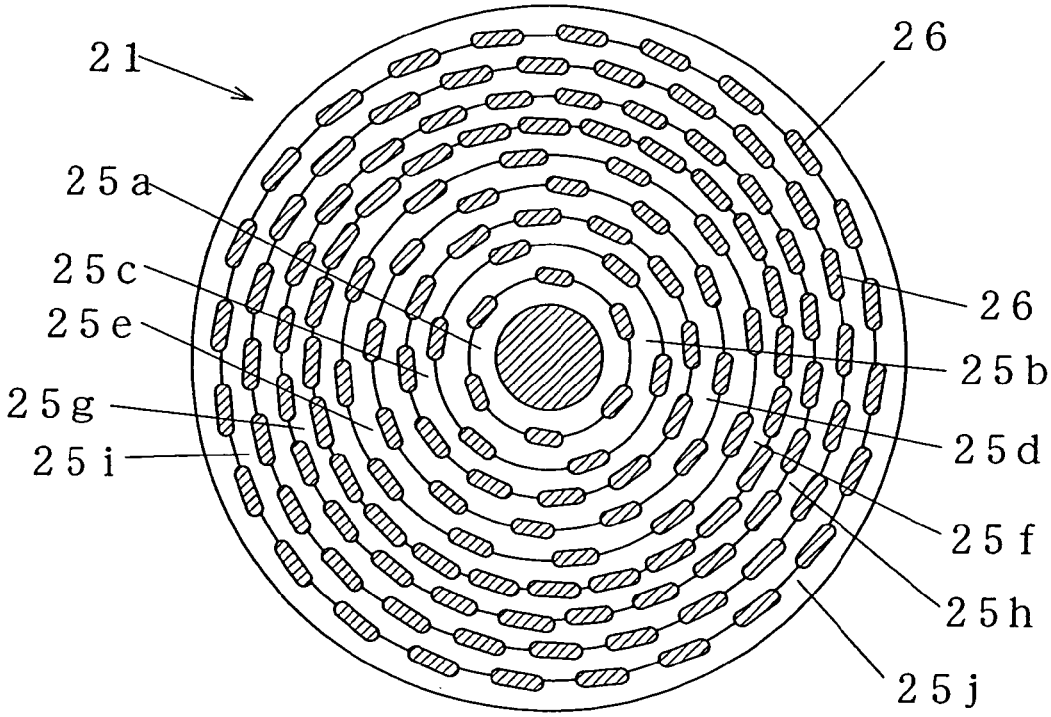
FIG. 7B is a plan view of a magnet plate according to Embodiment 2.

FIG. 7A is a sectional view showing the major parts of an electroacoustic transducer according to Embodiment 2, and FIG. 7B is a plan view of a magnet plate according to Embodiment 2.

In FIG. 7A and FIG. 7B, reference number 20 denotes an electroacoustic transducer according to Embodiment 2. A pair of magnet plates 21 and 22 are entirely formed to be like a disk, wherein the planes thereof opposed to each other are parallel to each other. An acoustic diaphragm 23 is disposed at an intermediate position of the magnet plates 21 and 22 and has a spirally formed conductor. Ten small magnets 25*a* through 25*j* constitute magnet plates 21 and 22, whose independent profile is formed to be ring-shaped, concentrically disposed at almost the same width in the radius direction and formed with the thickness thereof concentrically changed. Elliptical acoustic pores 26 are formed between the sides of adjacent small magnets 25*a* through 25*j*. Reference number 27 denotes the terminal portion of the conductor. A columnar supporting portion 28*a* supports the central portion side of the magnet plates 21 and 22, and the acoustic diaphragm 23, and a cylindrical supporting portion 28*b* supports the outer circumferential portion. An edge portion 29 resiliently couples the acoustic diaphragm 23 to the supporting portions 28*a* and 28*b* and has a suspension function.

The acoustic diaphragm 23 is formed to be entirely like a thin ring by spirally winding a conductor made of insulated copper-clad aluminum wire and coupling the same with an epoxy resin. A resiliently deformable edge portion 29 is provided at the outer circumferential side and inner circumferential side.

Ring-shaped small magnets 25*a* through 25*j* of sizes differing from each other, which constitute the magnet plates 21 and 22, are respectively magnetized at prescribed angles so that the contribution of the effective operating magnetic flux with respect to the conductor of the acoustic diaphragm 23 is maximized. Also, the intensities of magnetization are maximized and are all made constant.

Since it is difficult to directly magnetize the entirety of the magnet plates 21 and 22 at such prescribed angles, in the present embodiment, the magnet plates are divided into ring-shaped small magnets 25*a* through 25*j* which become partial areas, and the small magnets are combined after they are magnetized at prescribed angles, thereby constituting the magnet plates 21 and 22.

Although in the respective small magnets 25*a* through 25*j* the directions and intensities of magnetic forces acting on the respective small magnets are not constant, a repulsion force operates as a synthesized magnetic force between the magnet plates 21 and 22 which are composed as an entirety.

As shown in FIG. 7A, inclined portions are formed at the sides between respectively adjacent small magnets 25*a* through 25*j*, and support a force operating in the course in which magnetic forces generated in the small magnets 25*a* through 25*j* are transmitted to the supporting portions 28*a* and 28*b*, whereby the small magnets 25*a* through 25*j* are respectively prevented from falling, and at the same time are structured so as to be adhered to each other.

Further, the respective small magnets 25*a* through 25*j* are connected to each other with an adhesive agent such as a synthetic resin, etc. By employing such a structure, connection of the small magnets 25*a* through 25*j* that generate intensive magnetic forces does not depend upon an adhering force, and it is possible to prevent a shift from being generated between the small magnets 25*a* through 25*j* due to lack of adhering force.

In Embodiment 2, although the magnet plates 21 and 22 are respectively composed of ten small magnets 25*a* through 25*j*, each of which is formed to be ring-shaped, the entirety of the magnet plates 21 and 22 may be composed of three to twenty small magnets in accordance with the radius and thickness of the magnet plates 21 and 22 and the necessity of segmentation of the magnetization angle.

In addition, depressions are provided in advance on the adjacent sides of the ring-shaped small magnets 25*a* through 25*j*, wherein acoustic pores 26 can be formed of the depressions after combining the magnet plates 21 and 22 together. However, pores may be formed in the thickness direction of the small magnets 25*a* through 25*j* by drilling.

Further, the magnet plates 21 and 22 are formed with their thickness concentrically differing from each other. However, by concentrically varying the thickness of the magnet plates 21 and 22 and arrangement of the acoustic pores 26 for adjustment, it is possible to control the distribution state of an electromagnetic force to drive the acoustic diaphragm 23 with the contribution of the magnetic field set to a prescribed value, that is, a distribution of the effective operating magnetic flux densities with respect to the conductor of the acoustic diaphragm 23.

In the present embodiment, taking into consideration changes in the effective operating magnetic flux densities with respect to not only the vibration direction of the acoustic diaphragm 23 but also the radius direction thereof, the acoustic diaphragm 23 can be caused to uniformly vibrate by adjusting and controlling the distribution, etc., of the thickness of the magnet plates 21 and 22 as described below.

Where the acoustic diaphragm 23 does not uniformly vibrate at the same phase and same amplitude (does not make uniform vibration), this results in divided vibrations in which respective parts of the acoustic diaphragm 23 separately vibrate.

In order to cause the acoustic diaphragm 23 to uniformly vibrate, it is necessary to control by adjusting not only the distribution of the effective operating magnetic flux densities with respect to the conductor of the acoustic diaphragm 23 but also the stiffness of the edge portion 29 that resiliently supports the acoustic diaphragm 23, and the distribution, depth and profile, etc., of the acoustic pores. It is not necessarily the optimum method for making the acoustic diaphragm 23 to uniformly vibrate where the effective operating magnetic flux densities are made evenly uniform in the radius direction with respect to the conductor of the acoustic diaphragm 23. However, this is at least one of the effective and common methods. Therefore, the following control is employed in the present embodiment in order to make uniform the distribution of the effective operating magnetic flux densities in the radius direction with respect to the conductor of the acoustic diaphragm 23.

In FIG. 5A described above, where magnet plates that are magnetized at prescribed angles so that the contribution of the effective operating magnetic flux with respect to the conductor of the acoustic diaphragm is maximized as shown in the distribution of the effective operating magnetic flux densities at "a," the effective operating magnetic flux densities at the center portion of the acoustic diaphragm are lowered.

Even in a case where the magnetization directions of the partial areas of the magnet plates are established while gradually differing from each other, a pattern of the magnetization angles exists, by which the effective operating magnetic flux densities are almost evenly distributed in the radius direction of the acoustic diaphragm. However, in this case, the effective operating magnetic flux ratio is lowered and the utilization efficiency of the magnetic fluxes is deteriorated.

For this reason, in an electroacoustic transducer 20 according to Embodiment 2, with respect to the magnet plates 21 and 22, the thickness of small magnets at the center portion is increased to supplement a deficiency of the effective operating magnetic flux at the center portion in the conductor of the acoustic diaphragm 23, whereby compensation is made to maintain the effective operating magnetic flux ratio. Herein, it is possible to supplement the shortage in the effective operating magnetic fluxes by lowering the arrangement density of the acoustic pores 26 at the center portion of the magnet plates 21 and 22 or making the pore diameter smaller, etc.

Where the effective operating magnetic flux densities are compensated by the thickness of the magnet plates 21 and 22, the thickness is increased at portions where the effective operating magnetic flux densities are deficient in the conductor of the acoustic diaphragm 23, and the thickness is made thinner at an excessive portion so that the effective operating magnetic flux densities are decreased.

Where the thickness of the magnet plates 21 and 22 is partially varied at concentric areas, the effective operating magnetic flux densities may vary on the acoustic diaphragm 23 centering around the position having the same radius as that of the portion where the thickness is changed, or a portion close to the same radius.

Therefore, in actual work, the thickness of the magnet plates 21 and 22 is adjusted at concentric areas with respect to the portion which has the same radius as that of the position where the effective operating magnetic flux densities are compensated, or the portion close to the same radius, and the compensated effective operating magnetic flux densities are measured and checked. Or, similar work is carried out by simulations. By such a method, it is possible to adjust the distribution of the effective operating magnetic flux densities of the acoustic diaphragm 23 with respect to the conductor by repeating trial and error.

Where the magnet plates 21 and 22 that are magnetized at prescribed angles so that the contribution of the effective operating magnetic fluxes with respect to the conductor of the acoustic diaphragm 23 as in the present embodiment is maximized are used, the distribution of effective operating magnetic flux densities of the acoustic diaphragm 23 in the radius direction will be as shown by "a" in FIG. 5A in a flat state where no compensation is made with respect to the thickness of the magnet plates 21 and 22.

In view of making uniform the distribution of the effective operating magnetic flux densities in the radius direction of the acoustic diaphragm 23, the thickness pattern of the magnet plates 21 and 22 is not unitary. However, as in the present embodiment shown in FIG. 7A, generally, the thickness distribution will become such that the outer circumferential edge side is the thinnest and gradually be made thicker toward the center axis side.

When the effective operating magnetic flux densities by adjusting the distribution density of the acoustic pores 26 portion by portion in the magnet plates occur, the distribution density is increased, so that the effective operating magnetic flux densities are decreased, with respect to excessive portions of effective operating magnetic flux densities in the conductor of the acoustic diaphragm 23, and the distribution density is lowered, so that the effective operating magnetic flux densities are compensated, with respect to portions where the effective operating magnetic flux densities are deficient.

In actual work, the distribution density of the acoustic pores 26 is adjusted with respect to the portion which has the same radius as that of the portion where the effective operating magnetic flux densities are compensated, or the portion close to the same radius, and the compensated effective operating magnetic flux densities are measured and checked. Or, similar work is carried out by simulations. By such a method, it is possible to adjust the distribution of the effective operating magnetic flux densities of the acoustic diaphragm 23 with respect to the conductor by repeating trial and error.

The above-described compensation enables more optimal control by a method for carrying out by partially varying the material of the magnet plates 21 and 22 and the magnetization intensity thereof, a method for varying the size and profile of the acoustic pores 26, or a combination thereof.

It is possible for the magnet plates 21 and 22 to have an equalizer function to improve the characteristics in a high frequency band by attaching a horn to the outside surface thereof and disposing the acoustic pores 26 with the profile and sizes thereof differing from each other. In such a case, it is necessary to take into consideration acoustic impedance which varies due to an additional feature.

Further, where the amplitude of the acoustic diaphragm 23 is partially increased, it is possible to prevent the portion, in which the amplitude of the acoustic diaphragm 23 is increased, from being brought into contact with the magnet plates 21 and 22 by erasing a part of the surface of the magnet plates 21 and 22 opposed thereto in response to the amplitude of the acoustic diaphragm 23.

Thus, where the acoustic impedance is taken into consideration and where the profile of the magnet plates 21 and 22 is varied, acoustic design of an electroacoustic transducer 20 is enabled, while maintaining satisfactory distortion characteristics desired, if methods for adjusting the thickness, material and magnetization intensity of the magnet plates 21 and 22 and distribution density of the acoustic pores 26, etc., by concentrically varying the same, area by area, are used by combinations.

In addition, in Embodiment 2, using the magnet plates 21 and 22 magnetized at a prescribed angle by which the effective operating magnetic flux ratio is maximized, compensation is carried out by increasing the thickness of the center portion of the magnet plates 21 and 22 with respect to the center portion where the effective operating magnetic flux densities are lowered in the conductor of the acoustic diaphragm 23. However, by making the magnetization angle close to a pattern along which the effective operating magnetic flux densities of the acoustic diaphragm 23 with respect to the conductor can be almost evenly distributed in the radius direction, it is possible to decrease the amount of compensation by the thickness of the magnet plates 21 and 22 by slightly sacrificing the effective operating magnetic flux ratio, that is, the utilization efficiency of magnetic fluxes.

There exist a number of such patterns of useful magnetization angles in which the correlation between the effective operating magnetic flux ratio and degree of compensation is taken into consideration. However, in any case, the magnetization angles established by the vibration plane of the acoustic diaphragm have a distribution of gradually differing in response to the distance from the center axis of the magnet plates.

In Embodiment 2, compensation is carried out by adjusting the distribution of the magnet plates 21 and 22 in terms of the thickness. However, where changes in the effective operating magnetic flux densities of the acoustic diaphragm 23 with respect to the vibration direction are investigated in Embodiment 2 as in the case of FIG. 6 described above, it is understood that almost no influence is applied to the changes in the above-described densities even if the thickness of the magnet plates 21 and 22 is compensated, and an area (that is, diagonal line portion S) having only a slight change in the effective operating magnetic flux densities can be maintained in a wide range.

In Embodiment 2, by compensating the thickness with respect to the magnet plates 21 and 22 as described above, it is possible to make almost evenly uniform the distribution of the effective operating magnetic flux densities in the conductor of the acoustic diaphragm 23 not only in the vibration direction but also in the radius direction, whereby it becomes possible to make the acoustic diaphragm 23 at a further lower distortion state.

Since the electroacoustic transducer 20 according to Embodiment 2 is constructed as described above, the following actions can be obtained.

(a) The thickness of magnet plates 21 and 22, distribution of the acoustic pores 26, type of magnet material used, and magnetization intensity thereof, etc., are concentrically varied, and the distribution of the effective operating magnetic flux densities of the acoustic diaphragm 23 with respect to the conductor thereof is set to a pattern by which the acoustic diaphragm 23 is caused to uniformly vibrate in the radius direction, wherein it is possible to provide an electroacoustic transducer 20 having desired acoustic characteristics.

(b) It is possible to improve the acoustic characteristics by varying the distribution, profile, size and/or depth of the acoustic pores 26 and adjusting the acoustic impedance, wherein sound quality can be remarkably improved.

(c) Since small magnets 25*a* through 25*j* are formed to be ring-shaped, and the small magnets 25*a* through 25*j* are aggregated to constitute the entirety of the magnet plates 21 and 22, it becomes possible to individually magnetize the small magnets 25*a* through 25*j*. Since the entirety can be assembled with a comparatively small number of small magnets 25*a* through 25*j*, productivity is excellent.

(d) Since the entirety of the magnet plates 21 and 22 can be assembled with a small number of small magnets 25*a* through 25*j*, the number of junctions can be reduced, wherein it becomes possible to produce the magnet plates 21 and 22 which are excellent in strength and have high reliability.

(e) Since such a structure is employed, in which inclined portions are formed on adjacent planes of the small magnets 25*a* through 25*j* and are adhered to each other in the course that a magnetic force generated in the small magnets 25*a* through 25*j* is transmitted to the supporting portions 28*a* and 28*b*, the entirety can be assembled without using any intensive adhering means, wherein production can be facilitated.

(f) Since such a structure is obtained, in which it is difficult for the magnet plates 21 and 22 to shift in the thickness direction by means of the inclined portions formed on the adjacent planes of the small magnets 25*a* through 25*j*, it becomes possible to produce magnet plates 21 and 22 which are excellent in strength and have high reliability. Moreover, durability thereof is excellent.

(Embodiment 3)

Figure 8A:
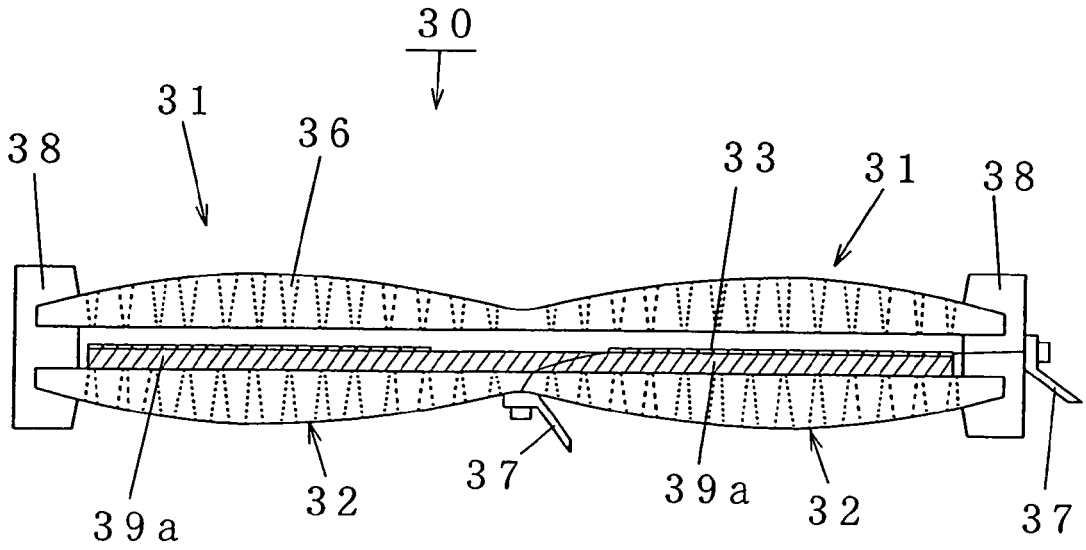
FIG. 8A is a sectional view showing the major parts of an electroacoustic transducer according to Embodiment 3.
Figure 8B:
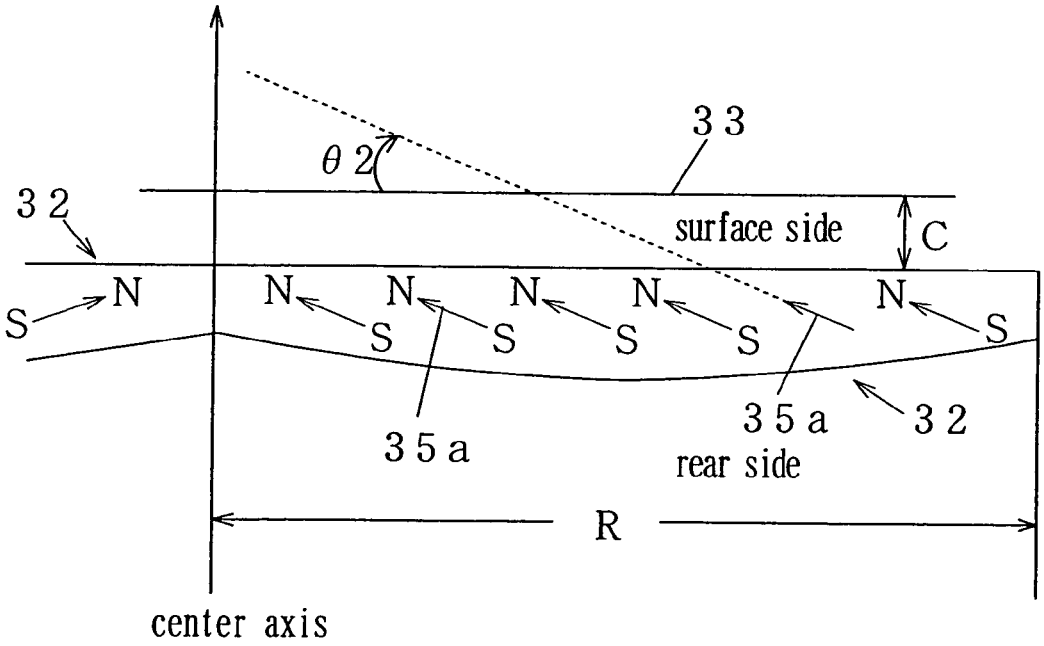
FIG. 8B is an exemplary view of a magnetization pattern of magnet plates in an electroacoustic transducer according to Embodiment 3.

FIG. 8A is a sectional view showing the major parts of an electroacoustic transducer according to Embodiment 3, and FIG. 8B is an exemplary view of a magnetization pattern of a magnet plate in an electroacoustic transducer.

In FIG. 8A, reference number 30 denotes an electroacoustic transducer according to Embodiment 3. A pair of magnet plates 31 and 32 have as the entirety a disk-shaped and thickness made concentrically differing from each other, and have the planes opposed to each other disposed parallel to each other. A thin disk-shaped acoustic diaphragm 33 is disposed at an intermediate position between the magnet plates 31 and 32 and has a spirally formed conductor. Acoustic pores 36 are formed in the magnet plates 31 and 32. Reference number 37 denotes the terminal portion of the conductor. A cylindrical supporting portion 38 holds the outer circumferential portions of the magnet plates 31 and 32. A disk-shaped holding plate 39*a* is made of foamed resin whose material is a soft synthetic resin such as a urethane foamed material or urethane, in order to resiliently support a vibrating acoustic diaphragm 33.

A conductor (not illustrated) made of aluminum, copper, etc., is spirally formed on the surface of the thin disk-shaped acoustic diaphragm 33 by means of deposition, plating, etching, etc.

Since the holding plate 39*a* supports the entirety of the acoustic diaphragm 33 in a uniform state, it is possible to maintain a satisfactory sound quality by suppressing distortion resulting from the tare weight of the acoustic diaphragm 33. In addition, since no edge portion as in Embodiment 1 is required by employment of the holding plate 39*a*, an effective area can be widely secured.

The electroacoustic transducer 30 according to Embodiment 3 maximizes the intensity of magnetization in respective partial areas of the magnet plates 31 and 32. Also, in magnetization vectors 35*a* of the respective partial areas, components parallel to the vibration plane of the acoustic diaphragm 33 are in the radius directions of the magnet plates 31 and 32, and as shown in FIG. 8B, all the angles θ2 established by the acoustic diaphragm 33 with respect to the vibration plane are made constant to be 20 degrees.

Further, the plane side on which the directions of the magnetization vectors 35*a* cross the center axes of the magnet plates 31 and 32 are made into the surface side of the magnet plates 31 and 32.

Since the effective operating magnetic flux density on the surface side becomes higher than that on the rear side, the surface sides of the magnet plates 31 and 32 are turned to the acoustic diaphragm 33 in the present embodiment.

The magnet plates 31 and 32 may be such as the rectangular-shaped or ring-shaped small magnets aggregated as in Embodiment 1 and Embodiment 2 as long as the entire profile is the same, or fan-shaped small magnets, which are formed by dividing a ring-shaped or disk-shaped magnet plate along the line that becomes the radius, are combined, or an independently disk-shaped magnet plate in which acoustic pores are drilled and prepared.

For magnet plates in which all the angles θ2 are made constant to be 20 degrees as in the present embodiment, where thin disk-shaped neodymium magnet plates are assumed, in which the respective conditions other than the magnetization direction of magnet plates are identical to those in the case of "a" in FIG. 5A, that is, the thickness is made 1% of the radius R, and the ratio (C/R) of the distance C from the two magnet plates to the acoustic diaphragm and the radius R of the magnet plates is made to be 0.1, the distribution of the effective operating magnetic flux densities of the acoustic diaphragm 33 with respect to the radius direction becomes as shown by "b" in FIG. 5A.

In the distribution of "b," the area of the effective operating magnetic fluxes contributing to the vibration of the acoustic diaphragm showed a feature by which a difference in the effective operating magnetic flux density is entirely decreased in comparison to the distribution of "a." In particular, in the distribution of "b," the effective operating magnetic flux density is depressed between the center portion and outer circumferential portion of the acoustic diaphragm. However, the low density part at the intermediate portion of the radius is reduced by increasing the ratio (C/R), wherein the difference can be decreased.

Also, where the distribution as at "a" and "b" in FIG. 5A is utilized in an electroacoustic transducer, the effective operating magnetic flux ratio of "b" is lowered to approximately 82% of the distribution of "a," wherein the utilization efficiency of magnetic fluxes is deteriorated. Further, since the converting efficiency of energy is proportional to almost the square of the effective operating magnetic flux ratio, the ratio (η2/η1) of the converting efficiency (η2) of the distribution of "b" and the converting efficiency (η1) of the distribution of "a" becomes 67% (82%×82%) or so.

With respect to the magnetization vectors 35*a* of the magnet plates 31 and 32, the angles θ2 established by the acoustic diaphragm 33 with respect to the vibration plane are made constant to be 20 degrees which are not zero. This is based on the following reason. That is, in the simulation, where the ratio (C/R) under the above-described conditions is made to be 0.1, the effective operating magnetic flux ratio is maximized when the angle θ2 made constant is made to be 30 degrees or so. However, it is understood that the larger the angle θ2 of the magnetization vector 35*a* becomes, the larger the difference in the distribution of the effective operating magnetic flux densities becomes, and the range of the distribution is widened to the outer circumferential side.

Therefore, in Embodiment 3, taking into consideration the effective operating magnetic flux ratio, the difference in the effective operating magnetic flux density distribution, and further the distribution range of the effective operating magnetic fluxes, the constant angle θ2 that is not zero is determined as 20 degrees, which is smaller than 30 degrees.

Also, in the electroacoustic transducer 30, the thickness is increased with respect to the magnet plates 31 and 32 in order to supplement the effective operating magnetic flux at the intermediate portion in the radius direction, which may become short, in the conductor of the acoustic diaphragm 33. Herein, it is possible to supplement the effective operating magnetic fluxes becoming short, by lowering the distribution density of the acoustic pores 36 with respect to the intermediate portion in the radius direction of the magnet plates 31 and 32 or disposing magnet plates whose magnetization is intensified by using a different material for the magnet plates.

For example, by using a magnet material enabling intensive magnetization at a portion whose thickness is made large, it is possible to make it thinner.

In addition, minute adjustment of the magnetic fields generated by the magnet plates is enabled by a combination of intensive magnets and weak magnets and a gradual change in the ratio thereof.

Thereby, since intensive magnets and weak magnets may be differently disposed part by part in accordance with the costs thereof, intensities of the magnetic fields required, coercive force thereof, etc., the optimum cost performance can be brought about.

Further, where acoustic pores are formed in magnet plates, the depths of the acoustic pores can be adjusted by partially adjusting the thickness of the magnet plates with a combination of intensive magnets and weak magnets, wherein the acoustic characteristics can be varied.

In Embodiment 3, the distribution of the effective operating magnetic flux densities is made uniform in the radius direction in the conductor of the acoustic diaphragm 33 by compensating the thickness of the magnet plates 31 and 32.

Where flat magnet plates which are not compensated with respect to the thickness are magnetized with all the angles θ2 made constant to be 20 degrees, and the ratio (C/R) is made to be 0.1, the distribution of the effective operating magnetic flux densities of the acoustic diaphragm with respect to the radius direction becomes as shown by "b" in FIG. 5A.

The pattern of thickness of the magnet plates 31 and 32 to make uniform the distribution of the effective operating magnetic flux densities in the radius direction of the acoustic diaphragm 33 is not unitary. However, generally, as in the present embodiment shown in FIG. 8A, such a thickness distribution is obtained, in which the intermediate portion between the center axis side and the outer circumferential side is thickest, and the thickness is made thinner toward the center axis side and outer circumferential side.

By adjusting the thickness of the magnet plates 31 and 32 as shown above and compensating the effective operating magnetic flux, the density distribution of effective operating magnetic flux densities, which is entirely almost uniform and is able to cause the acoustic diaphragm 33 to uniformly vibrate, is brought about at the position in the conductor of the acoustic diaphragm 33 in the electroacoustic transducer 30.

In addition, where the magnet plates 31 and 32 according to the present embodiment are used or magnet plates whose thickness is not compensated are used as the magnet plates 31 and 32, the area S is investigated, which has only a slight change in the effective operating magnetic flux densities of the acoustic diaphragm 33 with respect to the vibration direction as in the case of FIG. 6. It is understood that almost all of the profile, area, etc., are similar to those in Embodiments 1 and 2, and the area S is obtained in a wide range.

Thus, it is possible to provide an electroacoustic transducer 30 which causes the acoustic diaphragm 33 to adequately vibrate in a low distortion state, and is excellent in acoustic characteristics.

Further, in the present embodiment, the angles θ2 of the magnetization vectors 35*a* are made constant to be 20 degrees. However, where magnet plates are used in which the angle θ2 made constant is made to be zero, that is, all the magnetization directions of partial areas are made into the radius direction, it is understood, by carrying out verification using a neodymium magnet on the basis of the data obtained by the simulation, that the effective operating magnetic flux ratio is lowered to 89% or so in comparison to the present embodiment. In addition, since the converting efficiency of energy is proportional to the square of the effective operating magnetic flux ratio, the above-described ratio 89% becomes 79% that is the square thereof.

In this case, since it is not necessary to incline the magnetization directions of the magnet plates with respect to the plane of the magnet plates although the effective operating magnetic flux ratio is lowered, and the utilization efficiency of the magnetic fluxes is deteriorated, such a feature can be brought about, by which magnetization of the magnet materials can be facilitated. In particular, where magnet plates are prepared by combining ring-shaped small magnets or combining fan-shaped small magnets as in Embodiment 2, small magnets that become respective elements can be easily magnetized.

Accordingly, the magnet plates are constructed by aggregating the above-described small magnets, the distribution of the effective operating magnetic flux densities is set, by compensating the magnet plates with respect to the thickness and acoustic pores, to a pattern that causes the acoustic diaphragm to uniformly vibrate, whereby it is possible to easily produce an entire-surface-drive type flat speaker or microphone having less distortion and is excellent in the transition characteristics, which are the features of the present invention.

In the electroacoustic transducer 30 shown in FIG. 8A, the intensity of magnetization is maximized and is made constant in the respective partial areas, wherein even if the magnet plates 31 and 32 are disk-shaped, satisfactory distribution of effective operating magnetic flux densities as shown by "b" in FIG. 5A can be obtained. Therefore, it is possible to further increase the effective operating magnetic flux densities of the acoustic diaphragm in comparison to the case where the entire N and S poles of the magnet plates are not magnetized in the unit of partial areas but are magnetized so as to be integrally formed at the inner circumferential side and outer circumferential side as in the prior arts described in Publications (b) and (e).

Since the total magnetic fluxes at the N pole side are always equal to the total magnetic fluxes at the S pole side in a magnet although the effective area of the magnetic pole at the outer circumferential side becomes wider than the effective area of the magnetic pole at the inner circumferential side due to a difference in the radii thereof, the magnetization intensity and magnetic flux density at the outer circumferential side are further lowered than those at the inner circumferential side if the width of the ring-shaped magnet in the radius direction is increased, resulting in a lowering in the effective operating magnetic flux densities.

On the contrary, in the electroacoustic transducer 30, since the magnetization intensity thereof is maximized in the respective partial areas even in the case where the angles θ2 of the magnetization vectors 35*a* are zero, it is possible to secure a satisfactory distribution of effective operating magnetic flux densities as in the case shown by "b" in FIG. 5A even if the magnet plates are disk-shaped. Also, with respect to the N and S poles of the entirety of the magnet plates in this case, one magnetic pole is formed at the entire outer circumferential portion of the magnet plates while the other magnetic pole is formed gradually at the center side of the magnet plates in all the partial areas. That is, the other magnetic poles exist on the entirety of the magnet plates other than the outer circumferential portion thereof in a dispersed state. This is different from the prior arts in which the magnetic poles are provided only at the inner circumferential side.

Next, a description is given of the utilization efficiency of magnetic fluxes, depending on differences in these magnetization methods.

Two neodymium magnet plates which oppose each other are assumed in FIG. 5B. FIG. 5B is a graph comparing the effective operating magnetic flux densities at respective positions from the center side of the acoustic diaphragm to the vicinity of the outer circumferential portion thereof in each setting condition of the magnet plates where the ratio (C/R) of the distance C from the magnet plates to the acoustic diaphragm and the radius R of the outer circumference of the magnet plates is made to be 0.1. Further, thin ring-shaped magnet plates are assumed, in which the entirety thereof is composed of only a magnet and no acoustic pore exists, and the thickness thereof is made to be 1% of the radius R so that the effective operating magnetic flux ratio (U/V) is not influenced by the thickness. Also, the size of the outer circumferential portion position of the magnet plates, which is described on the abscissa of the graph in FIG. 5B, may be any figure as long as it meets the above-described conditions.

In the drawing, f2 shows a case where, as in the electroacoustic transducer according to the prior arts, the entirety of the magnet plates are ring-shaped, N and S poles are integrally formed at the inner circumferential side and outer circumferential side, and an interval between the outer radius R of the ring-shaped magnets and the inner radius r2 thereof, that is, the ring width W in the radius direction is made to be one-third (=R−r2) the outer radius R, and g2 shows a case where an interval between the outer radius R of the ring-shaped magnets and the inner radius r1 thereof, that is, the ring width W is made to be two-thirds (=R−r1) thereof. Further, such ring widths W are excessively wide and not practical with respect to the magnets that meet the above-described magnetization conditions, but are established as comparison examples.

In FIG. 5B, in magnet plates according to the present embodiment in which the intensity of magnetization of all the partial areas are maximized, graphs f1 and g1 are shown for comparison, which are obtained by making all the magnetization directions in the partial areas into the radius direction, and setting the entire profile and ring width W as in the case of f2 and g2 which are the graphs of the prior art examples.

In the assumption of a case where the above-described ring-shaped magnets are actually used for an electroacoustic transducer, the utilization efficiencies are compared per setting condition by using the ratio of the value (U) obtained by adding up the effective operating magnetic flux in a conductor of the acoustic diaphragm by an area of the conductor and the total cubic volume (V) of the magnets, that is, the effective operating magnetic flux ratio shown by U/V.

In the comparison of the utilization efficiencies of magnetic fluxes using the effective operating magnetic flux ratio, the utilization efficiency in the case of f1 where the ring width W is one-third the radius R is larger by approximately 1.25 times than in the case of f2, and, in the case of g1 where the ring width W is two-thirds the radius R, is larger by approximately two times than in the case of g2.

That is, in the cases (f1 and g1) of using magnet plates composed of a plurality of partial areas as in the present embodiment, in which the intensity of magnetization in respective partial areas is maximized, it is understood that the utilization efficiencies of magnetic fluxes is further improved than in the prior art cases (f2 and g2) using ring-shaped magnets that are magnetized so that N and S poles are integrally formed at the inner circumferential side and outer circumferential side, respectively. In addition, it is understood that the larger the width W of the ring-shaped magnets in the radius direction becomes, the larger the difference becomes.

Thus, in prior art electroacoustic transducers, since the utilization efficiency of magnetic fluxes is deteriorated if the ring width W is increased, ring-shaped magnets whose ring width W is basically narrow has been used. And, in the case of widening the area of the acoustic diaphragm, a plurality of ring-shaped magnets whose magnetization directions differ from each other have been used as a combination. However, where such ring-shaped magnets are merely combined, it is necessary to construct the acoustic diaphragm by combining a plurality of spiral conductors. Therefore, the respective combined spiral conductors independently vibrate (divided vibration), and uniform vibration of the entire acoustic diaphragm is interrupted, wherein it is difficult to secure acoustic characteristics having less distortion.

On the contrary, in a magnet plate in which the magnetization intensity is maximized in each partial area, satisfactory distribution of the effective operating magnetic flux densities can be obtained as in the case shown by "b" in FIG. 5A even if the ring width W is increased. Therefore, magnet plates can be used in a disk-shaped state, whereby the area of the acoustic diaphragm can be widely formed, and the conductor can be uniformly disposed on the entirety of the acoustic diaphragm. Then, it becomes possible to construct an electroacoustic transducer having less distortion, which is excellent in converting efficiency with high performance.

Since the electroacoustic transducer 30 according to Embodiment 3 is constructed as described above, the following actions can be obtained.

(a) Since all the N and S poles in partial areas of the magnet plates 31 and 32 are magnetized at a constant angle, it becomes easy to prepare the magnet plates 31 and 32 having target magnetization directions in comparison to magnet plates, in which the magnetization angles in the respective partial areas differ from each other, employed in Embodiments 1 and 2.

(b) Since, in comparison to the magnetic pole distribution of magnet plates employed in Embodiments 1 and 2, the magnetic pole distribution of the magnet plates 31 and 32 employed in the present embodiment presents only a slight difference in the effective operating magnetic flux densities in the conductor of the acoustic diaphragm 33, only slight compensation that utilizes the thickness of the magnet plates 31 and 32 and distribution density of the acoustic pores 36 is sufficient in the effective operating magnetic flux densities of the acoustic diaphragm 33 with respect to the conductor.

(c) Since uniform distribution of the effective operating magnetic flux densities is achieved as a whole at the positions of the conductor of the acoustic diaphragm 33, it is possible to cause the entire surface of the acoustic diaphragm 33 to uniformly vibrate by the holding plate 39*a* further uniformly supporting the entirety of the acoustic diaphragm 33.

(d) Since the holding plate 39*a* uniformly supports the entirety of the acoustic diaphragm 33, it becomes difficult for the installation position shift to arise even in a case where the area of the acoustic diaphragm 33 is widened.

(e) Since no edge portion is required by the holding plate 39*a* supporting the acoustic diaphragm 33, it is not necessary to secure the area therefor, wherein the degree of freedom in design can be increased. Therefore, if the area of a portion that becomes a diaphragm is increased by utilizing the widened portion, it is possible to increase the converting efficiency of energy.

(f) Even in a case where the effective operating magnetic flux densities are compensated by concentrically varying the thickness if the magnet plates 31 and 32 are composed of an aggregate of a plurality of small magnets and fan-shaped magnets obtained by dividing the magnet plate along the radius lines are used as the small magnets, common magnets magnetized at the same angle can be used as all the small magnets, wherein it becomes possible to easily produce an electroacoustic transducer 30 using inexpensive standardized small magnets.

(Embodiment 4)

Figure 9A:
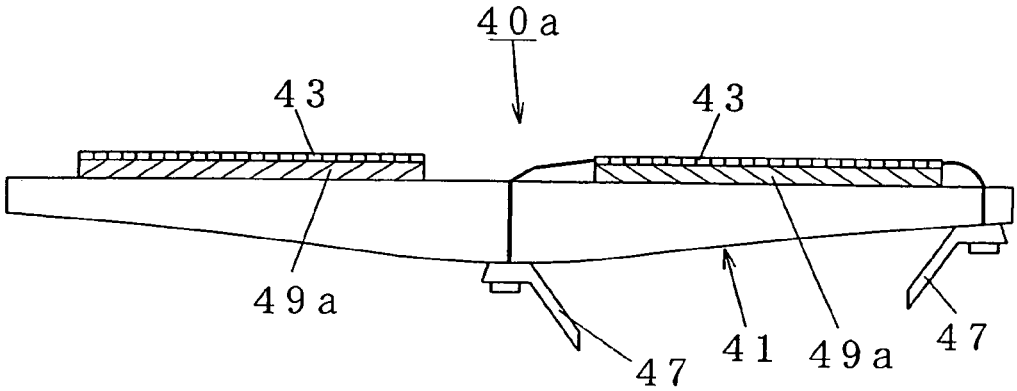
FIG. 9A is a sectional view showing the major parts of an electroacoustic transducer according to Embodiment 4.
Figure 9B:
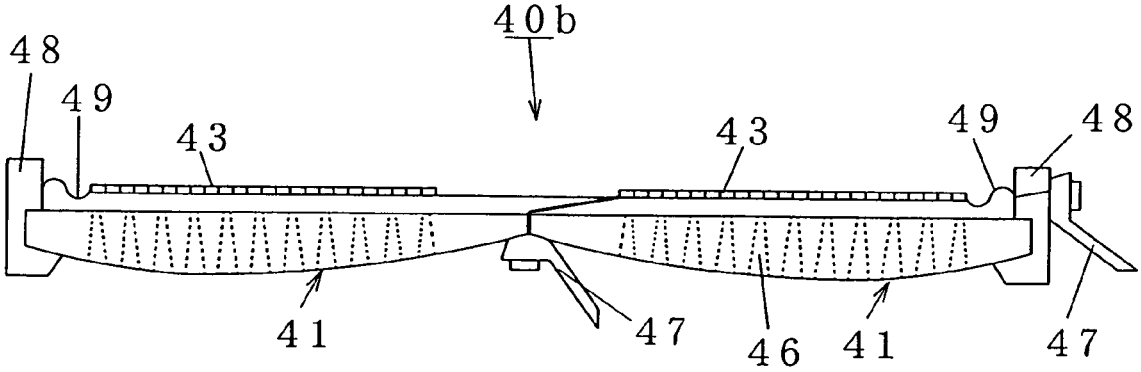
FIG. 9B is a sectional view showing the major parts of an electroacoustic transducer according to a modified version of Embodiment 4.

FIG. 9A is a sectional view showing the major parts of an electroacoustic transducer according to Embodiment 4, and FIG. 9B is a sectional view showing the major parts of an electroacoustic transducer according to a modified version thereof.

In FIG. 9A and FIG. 9B, reference number 40*a* denotes an electroacoustic transducer according to Embodiment 4. An electroacoustic transducer 40*b* is a modified version of the electroacoustic transducer 40*a*. A magnet plate 41 is made disk-shaped in its entirety. An acoustic diaphragm 43 has a spirally formed conductor. A ring-shaped holding plate 49*a* is composed of foamed resin, etc., whose material is polyurethane, etc., and resiliently supports the acoustic diaphragm 43 on the plane of the magnet plate 41 at prescribed spacing. A cylindrical supporting portion 48 is provided at the outer circumferential portion of the magnet plate 41. An edge portion 49 resiliently couples the acoustic diaphragm 43 to the cylindrical supporting portion 48 and has a suspension function. Acoustic pores 46 are drilled in the magnet plate 41. Reference number 47 denotes the terminal portion of the conductor.

A conductor (not illustrated) made of aluminum, copper, etc., is spirally formed on the surface of the acoustic diaphragm 43 by means of deposition, plating, and etching, etc.

Hereinafter, a description is given of the electroacoustic transducer 40*a* and 40*b* according to Embodiment 4.

Where the acoustic diaphragm is disposed between a pair of magnet plates, a change in the effective operating magnetic flux densities between the two magnet plates becomes symmetrical in the vibration direction centering around the center between the magnet plates, that is, the installation position of the acoustic diaphragm.

On the contrary, where a single magnet plate is disposed with respect to the acoustic diaphragm as in Embodiment 4, the effective operating magnetic flux densities at respective positions of a vibrating acoustic diaphragm become asymmetrical in the vibration direction with respect to the installation position of the acoustic diaphragm as the effective operating magnetic flux densities at the position of the acoustic diaphragm and at the vicinity thereof is gradually lowered in line with the acoustic diaphragm separating from the magnet plate. And, the degree of the change in the effective operating magnetic flux densities is determined by the ratio (y/R) of the distance y, along which the acoustic diaphragm is displaced in the vibration direction, to the radius R of the magnet plate.

For example, in a configuration in which the angles created by the magnetization vectors of the magnet plate and the vibration plane of the acoustic diaphragm are all made constant, and a single magnet plate is provided only at one side, where the acoustic diaphragm is displaced in the vibration direction by the distance y at which the ratio (y/R) becomes 0.4%, it is understood that the effective operating magnetic flux densities on the acoustic diaphragm change by approximately 1% on average due to simulation.

In the present embodiment where a single magnet plate 41 is disposed with respect to the acoustic diaphragm 43, where the magnet plate 41 is magnetized at the above-described constant angles, and the radius R is made to be 48 mm, since 0.4% of the radius 48 mm becomes approximately 0.2 mm, the range in which a change in the effective operating magnetic flux densities becomes 1% or less with respect to the vibration direction of the acoustic diaphragm 43 is approximately −0.2 mm through +0.2 mm on the basis of the installation position of the acoustic diaphragm 43.

On the contrary, where the acoustic diaphragm is disposed between the pair of magnet plates magnetized at the above-described constant angles, in an example in which the radius of the magnet plates is determined as 48 mm, spacing between the magnet plates is determined as 6 mm, and width of the acoustic pores formed on the magnet plates is determined as 0.8 mm or less, the range in which a change in the effective operating magnetic flux densities with respect to the vibration direction of the acoustic diaphragm becomes 1% or less is approximately −1 mm through +1 mm on the basis of the installation position of the acoustic diaphragm.

As described above, in the electroacoustic transducers 40*a* and 40*b* having such a configuration in which a single magnet plate is provided only at one side as in Embodiment 4, the degree of change in the effective operating magnetic flux densities with respect to the vibration direction of the acoustic diaphragm 43 is increased in comparison to a case where the acoustic diaphragm is disposed between the pair of magnet plates. Therefore, in order to use the electroacoustic transducers 40*a* and 40*b* in a low distortion state, it is necessary that usage targets electric signals whose amplitude does not become comparatively large. For example, since slight displacement of the acoustic diaphragm 43 with respect to the vibration direction may be generally sufficient in connection with electric signals of high frequency, the electroacoustic transducers 40*a* and 40*b* may be used in a low distortion state.

In the electroacoustic transducers 40*a* and 40*b*, the effective operating magnetic flux densities formed in the conductor of the acoustic diaphragm 43 may be set to a prescribed value by varying and compensating the thickness of the magnet plate 41 in the radius direction as shown in FIG. 9A and FIG. 9B.

In the electroacoustic transducer 40*a* shown in FIG. 9A, the holding plate 49*a* is caused to function as sound-absorbing materials, which is able to absorb acoustic waves generated rearward of the acoustic diaphragm 43, wherein the acoustic pores may be removed. And, by making the portion of the removed acoustic pores into a magnet material, the effective operating magnetic flux densities can be increased.

In addition, in the electroacoustic transducer 40*b* shown in FIG. 9B, the supporting portion at the center side and edge portions may be removed, the acoustic diaphragm 43 maybe formed to be disk-shaped, and the center portion is made into the diaphragm. Where the diameter of the acoustic diaphragm 43 is small or the stiffness of the edge portion 49 is large, the radiation area of acoustic waves can be widened by such a structure, wherein the converting efficiency of energy may be increased.

Since the electroacoustic transducers 40*a* and 40*b* according to Embodiment 4 are constructed as described above, the following actions may be obtained.

(a) Since the electroacoustic transducers 40*a* and 40*b* are composed of only a pair of a magnet plate 41 and an acoustic diaphragm 43, acoustic waves are discharged through a speaker, headphone, etc., by the acoustic diaphragm 43 without passing through acoustic pores, and are received by a microphone, etc., wherein the acoustic waves are not interrupted by other components.

(b) Since an intensive repulsion force is removed between the magnet plates as in the case where two magnet plates are opposed to each other, no mechanism for supporting the repulsion is required, and a possibility of generating any shift due to the repulsion force is removed.

(c) Since only one magnet plate 41 is sufficient, the structure can be simplified to reduce the number of components, and at the same time, the entire thickness of the electroacoustic transducer can be reduced to about half the thickness in the case of providing two magnet plates. A thin type transducer can be achieved.

(d) Since acoustic waves can be directly discharged or received by the acoustic diaphragm 43 without passing through the acoustic pores, limitations on the acoustic pores can be reduced, and it is possible to design the magnet plate 41 thickly to increase the effective operating magnetic flux densities.

(Embodiment 5)

Figure 10A:
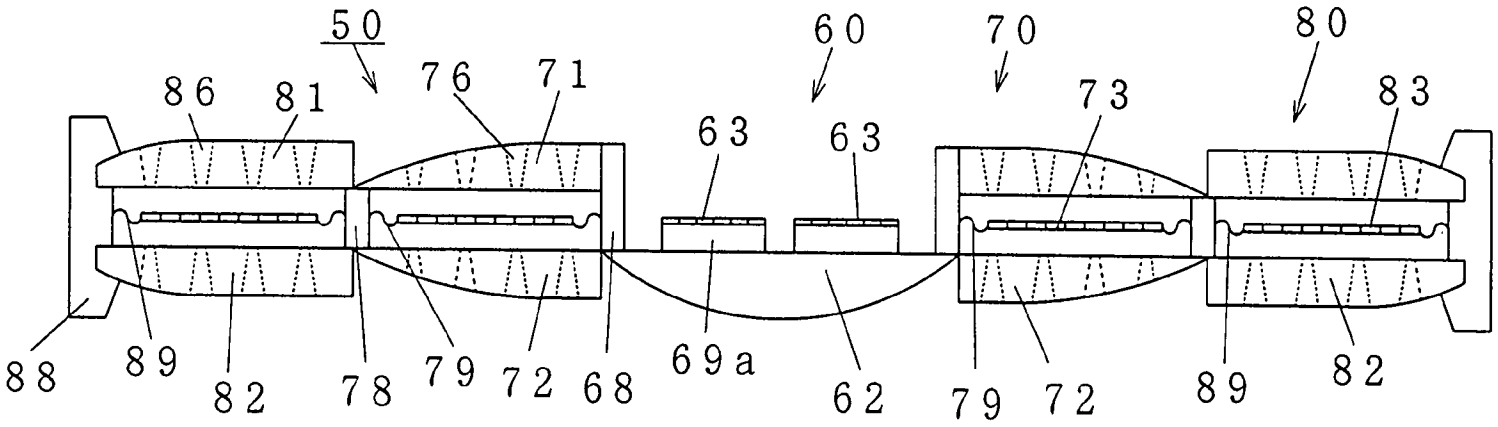
FIG. 10A is a sectional view showing the major parts of an electroacoustic transducer according to Embodiment 5.
Figure 10B:
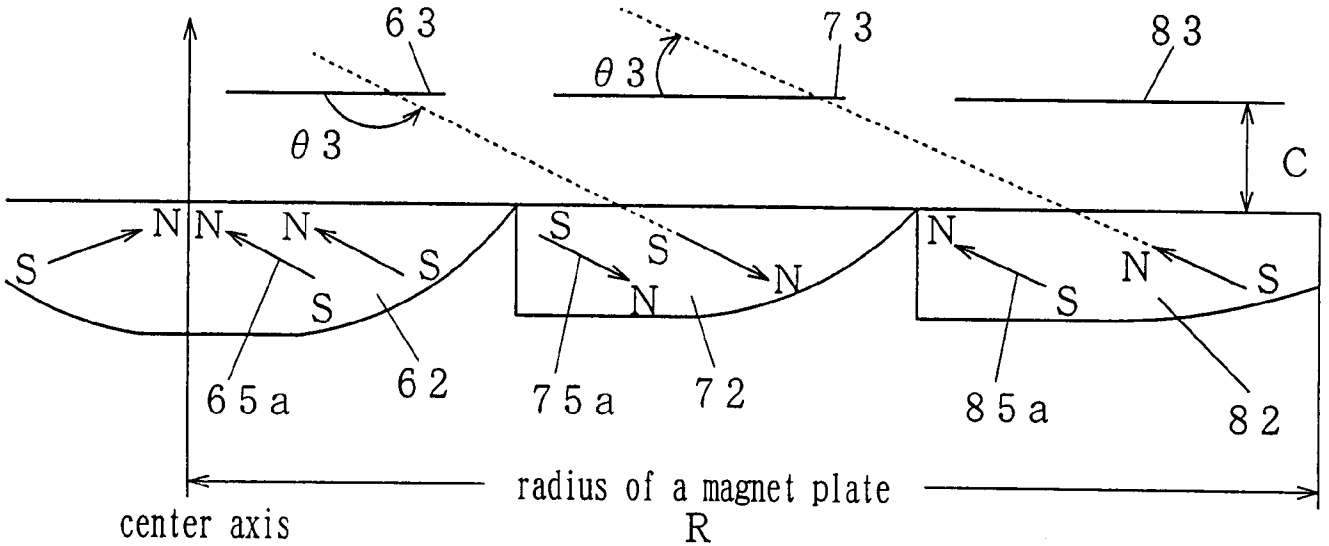
FIG. 10B is an exemplary view of a magnetization pattern of magnet plates in an electroacoustic transducer according to Embodiment 5.

FIG. 10A is a sectional view showing the major parts of a composite type electroacoustic transducer according to Embodiment 5, and FIG. 10B is an exemplary view of a magnetization pattern of partial areas in magnet plates according to Embodiment 5.

In FIG. 10A, reference number 50 denotes a composite type electroacoustic transducer according to Embodiment 5. Electroacoustic transducers 60, 70, and 80 compose the electroacoustic transducer 50 and are, respectively, constructed independently. Magnet plates 62, 71, 72, 81 and 82 have their profiles formed to be disk-shaped or ring-shaped as an entirety and have thickness concentrically differing from each other. Thin ring-shaped acoustic diaphragms 63, 73 and 83 have spirally formed conductors. Acoustic pores 76 are formed in the magnet plates 71 and 72. Acoustic pores 86 are formed in the magnet plates 81 and 82. A cylindrical supporting portion 68 composed of a non-magnetic body supports the outer circumferential portion of the magnet plate 62 and the inner-circumferential portion of the magnet plates 71 and 72. A supporting portion 78 holds the outer circumferential portion of the magnet plates 71 and 72 and the inner circumferential portion of the magnet plates 81 and 82. A supporting portion 88 holds the outer circumferential portion of the magnet plates 81 and 82. A ring-shaped holding plate 69*a* is made of foamed resin, etc., in order to resiliently support the acoustic diaphragm 63. An edge portion 79 resiliently couples the acoustic diaphragm 73 to the cylindrical supporting portions 68 and 78 and has a suspension function. Another edge portion 89 resiliently couples the acoustic diaphragm to the cylindrical supporting portions 78 and 88, and has a suspension function.

Conductors (not illustrated) made of aluminum, copper, etc., are spirally formed on the surfaces of the thin ring-shaped acoustic diaphragms 63, 73 and 83 by means of deposition, plating, etching, etc.

The composite type electroacoustic transducer 50 according to Embodiment 5 is constructed by coaxially (concentrically) disposing electroacoustic transducers 60, 70 and 80, which are respectively independent from each other and have sizes and acoustic characteristics differing from each other.

In the magnet plates 62, 71, 72, 81 and 82, the intensities of magnetization in respective partial areas are all made constant. Also, with respect to the magnetization vectors 65*a*, 75*a* and 85*a* of the respective partial areas, components parallel to the vibration planes of the acoustic diaphragms 63, 73 and 83 are in the radius direction of the magnet plates 62, 71, 72, 81 and 82, and, as shown in FIG. 10B, the angles θ3 created by the acoustic diaphragms 63, 73 and 83 with respect to the vibration planes are determined to be constant at 20 degrees for the magnetization vectors 65*a* and 85*a* and constant at −160 degrees, which become the opposite direction thereof, for the magnetization vector 75*a*.

Connections from peripheral devices to the terminal portions (not illustrated) of the conductors in the acoustic diaphragms 63, 73 and 83 are generally carried out individually, but may be carried out in parallel or in series.

With respect to the magnet plates 62, 71, 72, 81 and 82, by adjusting the thickness so as to supplement a shortage in the effective operating magnetic fluxes formed in the conductors of the acoustic diaphragms 63, 73 and 83, a density distribution of the effective operating magnetic fluxes can be achieved, by which the acoustic diaphragms 63, 73 and 83 can be caused to uniformly vibrate.

Hereinafter, a description is given of influences that the radius R of the magnet plate gives to the converting efficiency of energy of an electroacoustic transducer where the distance C from the magnet plate to the acoustic diaphragm is made constant.

Generally, the larger the radius R of the magnet plate becomes, the wider the area of the acoustic diaphragm can be made. Therefore, it is possible to increase the converting efficiency by widening the radiation area of acoustic waves and occupation area of the spirally formed conductors.

On the other hand, when the radius R of the magnet plates is increased by a certain degree or more with the distance C made constant, the effective operating magnetic flux ratio is lowered to worsen the utilization efficiency of magnetic fluxes. In magnet plates magnetized in a state where the angle θ3 created by the magnetization v ctor and the vibration plane of the acoustic diaphragm is constantly maintained at 20 degrees, where two thin disk-shaped neodymium magnet plates whose thickness is made to be 0.33% (⅓%) of the radius R is assumed, the distribution of the effective operating magnetic flux densities of the acoustic diaphragm with respect to the radius direction becomes as shown by "d" in FIG. 11 where the ratio (C/R) of the distance C and the radius R is determined as 1/30. Also, two magnet plates opposed to each other are based on the assumption that no acoustic pores composed only of the magnet as the entirety exist. In addition, the size of the outer circumferential portion position of the magnet plates described in the abscissa in the graph of FIG. 11 may be any figure as long as it meets the above-described conditions.

Figure 11:
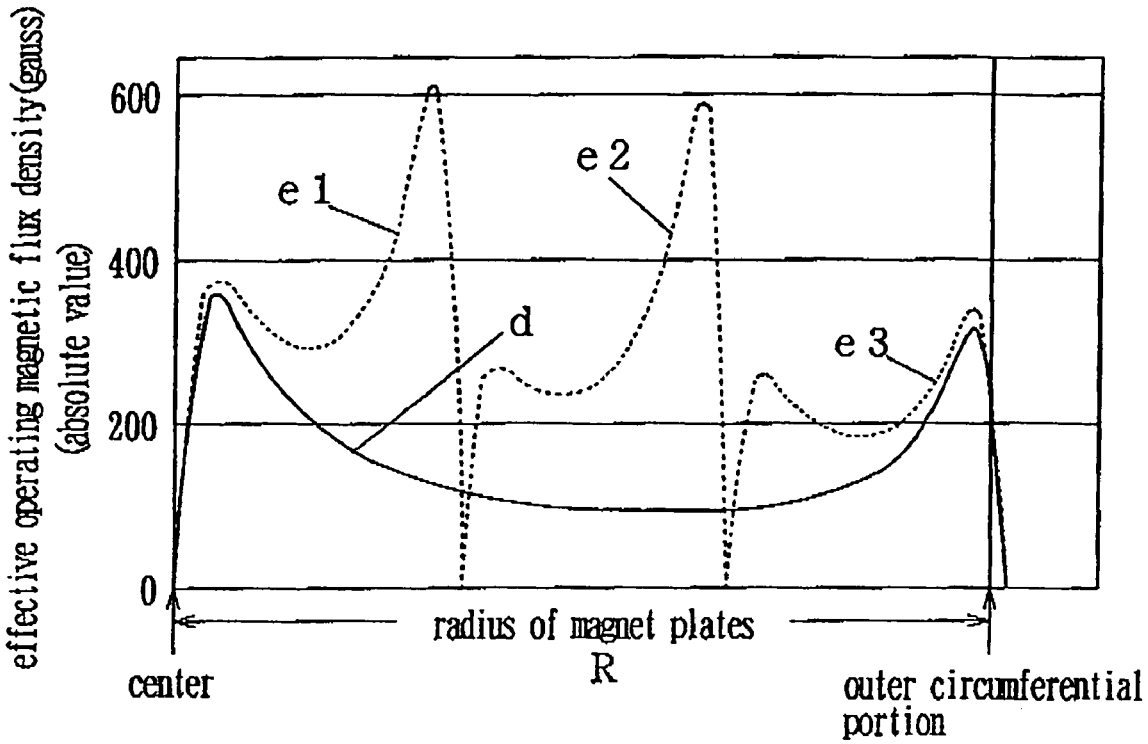
FIG. 11 is a graph showing absolute values of effective operating magnetic flux densities with respect to the radius direction of an acoustic diaphragm.

FIG. 11 is a graph of comparing effective operating magnetic flux densities at respective positions from the center side of the acoustic diaphragms to the vicinity of the outer circumferential portion thereof for each setting condition of the magnet plates.

The distribution of "d" in FIG. 11 becomes a pattern in which the effective operating magnetic flux densities are lowered between the center portion of the acoustic diaphragm and the outer circumferential portion thereof and the intermediate portion is depressed. However, the effective operating magnetic flux ratio in a case where the ratio (C/R) of the distribution of "d" is 1/30 is lowered to approximately 50% in comparison to the case of 0.1 (1/10), that is, the case where the distance C is the same and the radius is R/3. Also, since the converting efficiency of energy is proportional to almost the square of the effective operating magnetic flux ratio, the above-described ratio (50%) becomes 25% which becomes the square.

On the contrary, in the case where the magnet plates are divided into three types of disk-shaped and ring-shaped magnet plates as in this embodiment, the magnetization angle θ3 of the ring-shaped magnet plates at the center of the radius is established to be constant at −160 degrees which is in the opposite direction, a thin disk-shaped neodymium whose thickness is made to be 0.33% (⅓%) of the radius R as in the case of "d" is provided, the distribution of the effective operating magnetic flux densities of the acoustic diaphragm with respect to the radius direction becomes as shown by e1, e2, and e3 in FIG. 11.

Further, in FIG. 11, the effective operating magnetic flux densities are expressed in terms of absolute values for comparison. Actually, however, e2 becomes an effective operating magnetic flux that is opposite to the directions of e1 and e3.

The effective operating magnetic flux ratio obtained by averaging the entirety of the distributions e1, e2 and e3 of the effective operating-magnetic flux densities shown in FIG. 11 may be established to an effective operating magnetic flux ratio close to a case where the radius of the entirety of the magnet plates is R/3, that is, the ratio (Q/R) is determined as 0.1.

And, such a method may be applicable to other number of divisions. For example, in a case where the entirety of magnet plates are divided into four types of magnet plates, if the corresponding N and S poles of adjacent magnet plates are set so as to become the opposite direction to each other, the effective operating magnetic flux ratio can be made close to that in the state where the radius is R/4.

By carrying out magnetization with the magnet plates divided into magnet plates 62, 71, 72, 81 and 82 as described above in Embodiment 5, it is possible to maintain a satisfactory effective operating magnetic flux ratio, that is, satisfactory utilization efficiency of magnetic fluxes even in the case where the radius of the entirety of the magnet plates is increased in the electroacoustic transducer 50.

Further, even in the case where magnet plates whose magnetization angles θ3 of respective partial areas are set to prescribed angles while gradually differing from each other with respect to the distance from the center axis of the magnet plates are used although magnet plates all the angles θ3 of which are made constant at 20 degrees or −160 degrees in the present embodiment are used, completely similar effects can be obtained. In this case, the magnet plates are magnetized by independent patterns based on respective prescribed angles so that the respective magnet plates 62, 71, 72, 81, and 82 can independently function as the magnet plate of the present invention, and the corresponding N and S poles of adjacent magnet plates 62, 71, 72, 81 and 82 are established so as to become the opposite direction to each other.

Still further, where magnet plates all the magnetization angles θ3 at the respective partial areas are determined to be constant and those whose magnetization angles are established at prescribed angles while gradually differing from each other with respect to the distance from the center axis of the magnet plates are combined, similar effects can be obtained.

In the composite type electroacoustic transducer 50, taking the radiation area of acoustic waves and the electric impedance, etc., into consideration, the electroacoustic transducer 60 is used for a high frequency band, the electroacoustic transducer 70 is used for a mid frequency band, and the electroacoustic transducer 80 is used for a low frequency band per frequency band.

In the electroacoustic transducers 40*a* and 40*b* in which a single magnet plate is provided as in Embodiment 4, the degree of change in the effective operating magnetic flux densities of the acoustic diaphragm 43 with respect to the vibration direction becomes large. However, the electroacoustic transducer 40*a* and 40*b* according to Embodiment 4 can be used in a low distortion state if it targets electric signals that do not require comparatively large amplitudes such as high frequency signals.

Therefore, the composite type electroacoustic transducer 50 according to Embodiment 5 is structured so that the electroacoustic transducer 60 is used for high frequency is composed of a single magnet plate and acoustic waves generated by the acoustic diaphragm 63 are not caused to pass through acoustic pores.

In addition, acoustic pores of the magnet plate 62 are removed by causing the holding plate 69*a* to function as a sound-absorbing material and absorbing acoustic waves generated rearwards of the acoustic diaphragm 63.

Also, in the present embodiment, all the distances C from the magnet plates 62, 71, 72, 81 and 82 to the respective acoustic diaphragms 63, 73 and 83 corresponding thereto are made common, and the distances are matched to the maximum amplitude of the acoustic diaphragm 83, whose amplitude is maximized, for a low frequency band. However, as for the acoustic diaphragms 63 and 73, it is possible to improve the effective operating magnetic flux ratio by increasing the effective operating magnetic flux densities while employing the distances C responsive to the respective maximum amplitudes and adjusting the same shortly.

Further, such a structure may be employed, in which conductors of the acoustic diaphragms 63, 73 and 83 are formed on a single diaphragm and the entirety thereof is caused to integrally vibrate.

In this case, since the direction of the effective operating magnetic fluxes in the portion of the acoustic diaphragm 73 is opposite to that of the acoustic diaphragms 63 and 83, the entirety is constructed so that the conductors formed on a single diaphragm are disposed so that a drive current flows alternately in inverted directions, corresponding to the direction of the above-described effective operating magnetic flux and the acoustic diaphragm is uniformly driven with the phases in acoustic vibration matched to the entirety of the acoustic diaphragm.

The effective operating magnetic flux ratio is liable to decrease due to the radius of the entirety of the magnet plate being increased in line with an increase in the diameter of, for example, a speaker where, with such a construction method, the radius of the magnet plates is increased in comparison to the distance from the magnet plate to the acoustic diaphragm. However, in such a case, it is possible to bring about a design with the effective operating magnetic flux ratio appropriately maintained.

Since the composite type electroacoustic transducer 50 according to Embodiment 5 is constructed as described above, the following actions can be obtained.

(a) The utilization efficiency of magnetic fluxes is liable to worsen since the effective operating magnetic flux ratio is lowered in line with the radius of the magnet plates becoming large. However, since the entirety of the magnet plates that constitute the electroacoustic transducer 50 are divided into a plurality of ring-shaped magnet plates 62, 71, 72, 81 and 82, which are, respectively, magnetized so as to independently function as the magnet plate of the invention, and the corresponding N and S poles of adjacent magnet plates 62, 71, 72, 81 and 82 are established so as to be the opposite direction to each other, the substantial radius of the magnet plates can be made small, and the effective operating magnetic flux ratio can be prevented from being lowered.

(b) Since the electroacoustic transducers 60, 70 and 80 of the invention, which have acoustic characteristics differing from each other, are combined to be a composite type, it is possible to construct a composite type electroacoustic transducer 50 that is excellent in acoustic characteristics, utilizing the features of the respective electroacoustic transducers 60, 70 and 80.

(c) Since the respective electroacoustic transducers 60, 70 and 80 are concentrically (coaxially) disposed, such a structure that is excellent in phase characteristics and directional characteristics can be obtained.

(Embodiment 6)

Figure 12A:
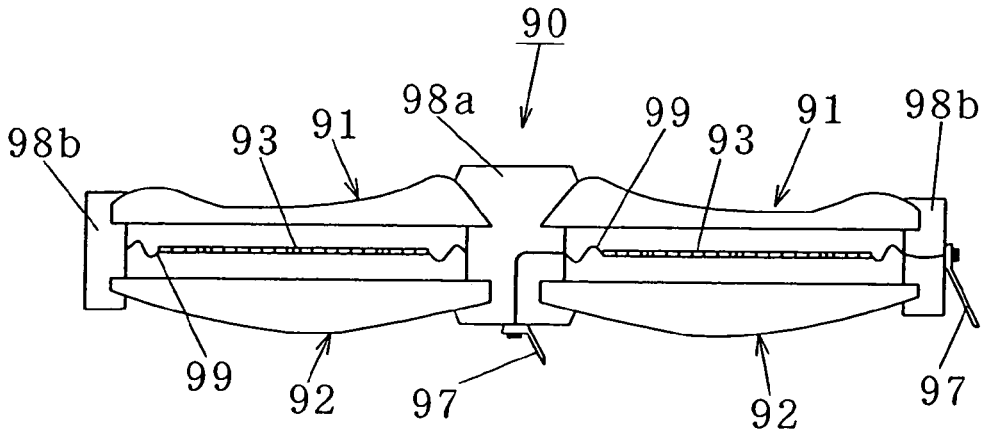
FIG. 12A is a sectional view showing the major parts of an electroacoustic transducer according to Embodiment 6.
Figure 12B:
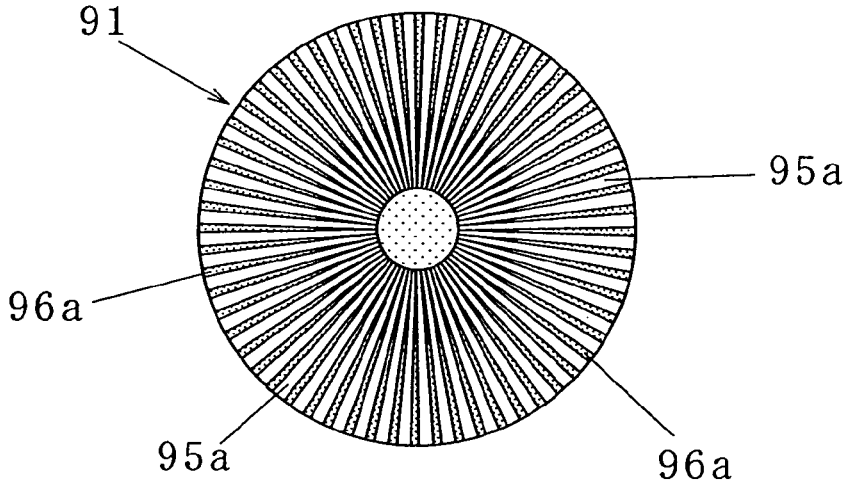
FIG. 12B is a plan view of a magnet plate disposed forward of the acoustic diaphragm.
Figure 12C:
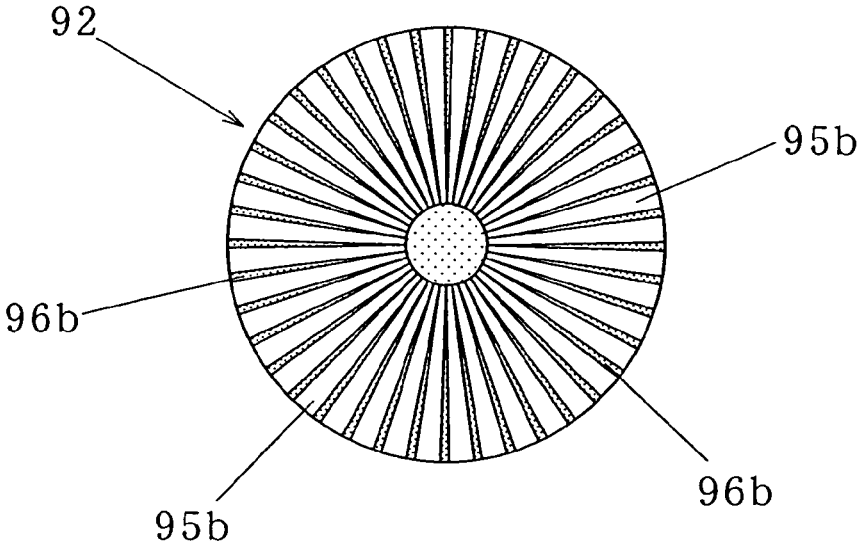
FIG. 12C is a plan view of a magnet plate disposed rearward of the acoustic diaphragm.

FIG. 12A is a sectional view showing the major parts of an electroacoustic transducer according to Embodiment 6, FIG. 12B is a plan view showing a magnet plate disposed forward of the acoustic diaphragm, and FIG. 12C is a plan view showing a magnet plate disposed rearward of the acoustic diaphragm.

In FIG. 12A, FIG. 12B and FIG. 12C, reference number 90 denotes an electroacoustic transducer according to Embodiment 6. The forward magnet plate 91 is disk-shaped in its entirety and has a thickness at the intermediate portion between the center axis side and the outer circumferential edge side, which is formed to be thinner than that of the center portion and the outer circumferential portion. A rearward magnet plate 92 is disk-shaped in its entirety, is thickest at the intermediate portion between the center axis side and the outer circumferential edge portion, and is formed so as to gradually become thinner toward the center axis side and the outer circumferential edge side, in which the plane thereof opposed to the plane of the magnet plate 91 is disposed parallel to each other. An acoustic diaphragm 93 is disposed at an intermediate position between the magnet plates 91 and 92 and has a spirally formed conductor. Small magnets 95*a* are, respectively, formed to be fan-shaped as independent profiles, and construct the magnet plate 91, and small magnets 95*b* are, respectively, formed to be fan-shaped as independent profiles, and construct the magnet plate 92. Fan-shaped acoustic pores 96*a* are formed between the small magnets 95*a* adjacent to each other, and fan-shaped acoustic pores 96*b* are formed between the small magnets 95*b* adjacent to each other. Reference number 97 denotes the terminal portion of the conductor. A columnar supporting portion 98*a* holds the center portion side of the magnet plates 91 and 92 and the acoustic diaphragm 93. A cylindrical supporting portion 98*b* holds the outer circumferential portion. An edge portion 99 resiliently couples the acoustic diaphragm 93 to the supporting portions 98*a* and 98*b* and has a suspension function.

The acoustic diaphragm 93 is formed to be thin ring-shaped in its entirety by spirally winding a conductor made of an insulated copper-clad aluminum wire and coupling the same with an epoxy resin. Resiliently deformable edge portions 99 are provided at the outer circumferential edge side and the inner circumferential edge side.

The electroacoustic transducer 90 reduces interference of acoustic waves by the magnet plate 91 by differing and adjusting the distribution of respective thickness of the magnet plates 91 and 92, and at the same time, makes the distribution of the effective operating magnetic flux densities uniform in the conductor of the acoustic diaphragm 93 in the radius direction.

Not only the number of acoustic pores 96*a* in the magnet plate 91 but also the area ratio of the acoustic pores 96*a* occupying the entirety of the magnet plates 91 are increased in comparison to those of the acoustic pores 96*b* in the magnet plate 92. Thus, interference of the magnet plate 91 is further reduced in radiation of acoustic waves by increasing the area ratio of the acoustic pores 96*a*.

Since the thickness at an intermediate portion between the center axis side and the outer circumferential edge side is formed thinner than that of the center portion and the outer circumferential portion in the magnet plate 91 although acoustic waves generated forward from the acoustic diaphragm 93 are radiated outside through the magnet plate 91, it is possible to increase the transmissivity of acoustic waves.

Thus, such a structure is employed, in which by making thin the thickness of the magnet plate 91 in the vicinity of the acoustic diaphragm 93, interference of acoustic waves, generated by the acoustic diaphragm 93, by the magnet plate 91 is reduced, and the acoustic waves are radiated outside.

Thus, the thickness distribution of the magnet plate 91 is first determined, and next the thickness distribution of the magnet plate 92 is determined so that the distribution of the effective operating magnetic flux densities in the conductor of the acoustic diaphragm 93 is made uniform in the radius direction.

In the magnet plates 91 and 92, the intensities of magnetization at respective partial areas are all made constant. Also, in the magnetization vector (not illustrated) in the respective partial areas, components parallel to the vibration plane of the acoustic diaphragm 93 are in the radius direction of the magnet plates 91 and 92, and all the angles established by the acoustic diaphragm 93 with respect to the vibration plane are made constant to be 20 degrees.

Thus, in the magnet plates 91 and 92 having such a magnetization angle, the thickness distribution of the magnet plate 92 making the distribution of effective operating magnetic flux densities uniform in the radius direction in the conductor of the acoustic diaphragm 93 along with the magnet plate 91 generally is, as shown as the magnet plate 92 in FIG. 12A, a distribution of thickness such that the intermediate portion between the center axis side and the outer circumferential edge side is thickest and the thickness is gradually made thinner toward the center axis side and the outer circumferential edge side.

An electroacoustic transducer structured to have two magnet plates has a feature by which highly effective operating magnetic flux densities can be formed at the position of the acoustic diaphragm 93, and at the same time, a change in the effective operating magnetic flux densities of the acoustic diaphragm 93 with respect to the vibration direction can be reduced.

In addition to these features, since, in the electroacoustic transducer 90, the thickness distribution of the magnet plate 91 is adjusted so as to decrease interference of acoustic waves by the forward magnet plate 91, the electroacoustic transducer 90 has a feature by which acoustic waves generated by the acoustic diaphragm 93 can be radiated outside in a low distortion state.

As described above, it is possible to achieve the electroacoustic transducer 90 in which the converting efficiency is increased while maintaining very satisfactory sound quality.

Since the electroacoustic transducer 90 according to Embodiment 6 is constructed as described above, the following actions can be obtained.

(a) Since the thickness at the intermediate portion between the center axis side and the outer circumferential edge side is formed thinner than that at the center portion and the outer circumferential portion in the forward magnet plate 91, the thickness at the intermediate portion is made thin, wherein interference of acoustic waves, generated from the acoustic diaphragm 93, by the magnet plate 91 can be reduced, and can be radiated outside. Therefore, it is possible to maintain low distortion of the generated acoustic waves.

(b) Since the area ratio occupied by all the acoustic pores 96*a* in the forward magnet plate 91 is made greater than the area ratio of the all the acoustic pores 96*b* in the magnet plate 92, acoustic waves generated by the acoustic diaphragm 93, in which interference by the magnet plate 91 can be further reduced, can be discharged outside.

(c) By setting differently the patterns of the thickness of the magnet plates 91 and 92, respectively, the depths of the acoustic pores, which are determined by the thickness of the magnet plates can be changed, whereby since it is possible to minutely adjust the acoustic characteristics such as resonance, etc., of the acoustic diaphragm 93 by the magnet plates 91 and 92, the frequency characteristics can be made further uniform in comparison to the case where the thickness distribution of two magnet plates is made the same.

(d) Since fan-shaped small magnets 95*a* and 95*b* consisting of one type are aggregated as the small magnets 95*a* and 95*b* to constitute respective magnet plates 91 and 92, the magnet plates 91 and 92 can be produced by using an inexpensive standardized material.

(e) All the fan-shaped small magnets 95*a* and 95*b* are directly attached to the supporting portions 98*a* and 98*b*, and have excellent strength.

As described above, although the invention is described by using Embodiments 1 through 6, the present invention is not limited to these embodiments. For example, with regard to the magnet plates, descriptions were given, in the respective embodiments, of cases where rectangular-shaped, ring-shaped, fan-shaped small magnets are combined, or disk-shaped and ring-shaped magnets are independently used. However, any combination thereof may be acceptable as long as the entire profile is disk-shaped or ring-shaped.

Magnet plates whose profile is circle-deformed such as elliptical or oval, etc., can bring about effects similar to the above because the magnet plates can fundamentally operate by the principle of the invention. However, the closer to a circle the outer profile becomes, the further uniform the distribution in the effective operating magnetic flux densities of the acoustic diaphragm with respect to the conductor becomes.

Further, the acoustic diaphragm can be vibrated at a low distortion state in the electroacoustic transducer according to the invention. Therefore, where the drive principle of the present invention is applied to a drive system composed of voice coils and magnetic circuits in a cone-type speaker, dome-type speaker, etc., the effects can be displayed.

Still further, the electroacoustic transducers according to the invention are not limited to specified sizes and materials, which are shown in the respective embodiments, and the magnetic poles described herein may be arranged with the N and S poles reversed.

INDUSTRIAL APPLICABILITY

According to the electroacoustic transducer described in the first aspect of the invention, the following effects can be obtained.

(a) Since the magnetizing direction can be set by the direction for magnetization in respective partial areas of magnet plates so that the contribution to the effective operating magnetic flux of the respective acoustic diaphragm with respect to the conductor is maximized, it is possible to effectively generate the magnetic flux in the radius direction along the vibration plane of the acoustic diaphragm, wherein an area having a highly effective operating magnetic flux density can be secured in a considerably wide range.

(b) Since the area in which the effective operating magnetic flux density is made high can be secured in a considerably wide range at the position of the acoustic diaphragm, it is possible to generate a drive force resulting from an electromagnetic force at the entire surface of the acoustic diaphragm by disposing a conductor on the entire surface of the acoustic diaphragm, whereby it becomes possible to design an acoustic diaphragm in which the entire surface of the vibration plane can be actuated in the same phase, and an entire-surface-drive type plane speaker having an ideal low distortion factor can be obtained.

(c) While securing an area of a necessary effective operating magnetic flux density in a wide range since the magnetizing directions of the magnet plates in the respective partial areas are set to respective prescribed angles with respect to the vibration plane of the acoustic diaphragm, the effective operating magnetic flux density in the respective positions in the vibration direction of the acoustic diaphragm has a distribution having slight changes. Therefore, distortion resulting from a difference with respect to the degree in the effective operating magnetic flux density in the vibration direction of the acoustic diaphragm can be controlled, the quality of sound generated in a speaker, headphone, etc., and electric signals converted from sound in a microphone, etc., can be maintained at a favorable level.

(d) Since, in the case of disposing an acoustic diaphragm parallel to and between two magnet plates as a pair, a change in the effective operating magnetic flux density with respect to the vibration direction can be decreased in comparison to the case where a single magnet plate is provided, an excellent sound quality can be maintained in a case where the amplitude of the acoustic diaphragm becomes large or a difference is more or less generated in the installation position of the acoustic diaphragm.

(e) Where an acoustic diaphragm is disposed between two magnet plates, the effective operating magnetic flux density can be increased in comparison to the case where a single magnet plate is provided.

According to the electroacoustic transducer described in the second aspect of the invention, the following effects can be obtained in addition to those of the first aspect.

(a) Since the magnetizing direction of the magnet plates is determined at a constant angle with respect to the vibration plane of the acoustic diaphragm, it becomes easier to design and manufacture the magnet plates in comparison to a case where the magnetizing direction of the magnet plates is determined to be an angle that is caused to gradually differ with respect to the distance from the center axis of the magnet plates.

(b) Since the magnetizing direction of the magnet plates is determined at a constant angle with respect to the vibration plane of the acoustic diaphragm, a difference in the effective operating magnetic flux density with respect to the radius direction of the acoustic diaphragm can be reduced in comparison to a case where the magnetizing direction is determined to be an angle at which the magnetizing directions gradually differ from each other with respect to the distance from the center axis, and compensation necessary to optimize the distribution of the effective operating magnetic flux densities can be reduced.

(c) Where the effective operating magnetic flux density is corrected by varying the distribution of thickness of the magnet plates, the correcting amount based on the thickness can be reduced, and influences upon the acoustic characteristics, which are exerted by the depth thereof can be reduced in the acoustic pores formed in the magnet plates.

According to the electroacoustic transducer described in the third aspect of the invention, the following effects can be obtained in addition to those of the first aspect or the second aspect.

(a) Even if the magnet plate has a complicated magnetizing pattern since the magnet plate is composed of an aggregate of small magnets, it can be comparatively easily achieved by arranging a number of small magnets that are magnetized in advance at prescribed angles.

(b) Intensive magnetization is independently enabled on the respective small magnets, and it becomes possible to produce a magnet plate that maximizes the performance of magnet materials.

(c) It becomes easy to vary the magnetizing angle, magnetizing intensity, size, etc., of the respective small magnets that constitute the magnet plate in a prescribed value, whereby the distribution state of the effective operating magnetic flux densities in the conductor of the acoustic diaphragm can be easily adjusted in accordance with the acoustic characteristics required.

(d) Since gaps between small magnets can be utilized as acoustic pores, no drilling work is required to produce acoustic pores, wherein an electroacoustic transducer having excellent sound quality can be simply constructed.

(e) Since the magnet plate can be formed by using the same shape of small magnets which have the same magnetizing intensity, and disposing the small magnets while varying the angles thereof with respect to the vibration plane of the acoustic diaphragm of the respective N and S poles, it is possible to produce an electroacoustic transducer using inexpensive standardized materials. In this case, disk-shaped magnets magnetized in the diametrical direction are used as the small magnets, and the planes of the small magnets are made perpendicular to the plane of the magnet plate and the small magnets are concentrically disposed so that the diametrical direction thereof is made into the radius direction of the magnet plate. And, if the small magnets are used with the angles of the N and S poles varied, influences exerted by the profile of the small magnets due to a change in the angle thereof with respect to the acoustic pores and surrounding small magnets can be reduced.

According to the electroacoustic transducer described in the fourth aspect of the invention, the following effects can be obtained in addition to those of the first aspect through the third aspect.

(a) By gradually increasing the thickness of the magnet plate from the outer circumferential edge side toward the center axis side and causing the contribution of magnetic fields at respective positions of the magnet plate to gradually differ from each other, it is possible to increase the effective operating magnetic flux density at the center axis side with respect to a case where the effective operating magnetic flux density is liable to be lowered at the center axis side of the acoustic diaphragm. It is possible to set the distribution of the effective operating magnetic flux densities to a pattern along which the acoustic diaphragm makes uniform vibrations, and the vibration characteristics of the acoustic diaphragm can be easily optimized.

(b) Where a supporting portion of the magnet plate is placed at the center axis side and outer circumferential edge side of the magnet plate, since the central portion of the magnet plate, at which the supporting strength is most required, is thickened, a structure which is excellent in terms of strength, can be obtained.

(c) Since the thickness of the magnet plate is gradually varied, it is possible to gradually and gently vary the depth of acoustic pores that are drilled in the magnet plate, whereby the acoustic impedance that varies along with the depth of the acoustic pores is not radically changed, and it is possible to prevent irregular vibrations at the acoustic diaphragm.

According to the electroacoustic transducer described in the fifth aspect of the invention, the following effects can be obtained in addition to those of any one of the first aspect through the third aspect.

(a) By making the thickness at the intermediate portion between the center axis side and the outer circumferential edge side thicker than that at the above-described center axis side and the above-described outer circumferential edge side in the magnet plate and causing the contribution of magnetic fields at respective positions of the magnet plate to gradually differ from each other, it is possible to increase the effective operating magnetic flux density at the above-described intermediate portion particular to a case where the effective operating magnetic flux density is lowered at the above-described intermediate portion of the acoustic diaphragm. It is possible to set the distribution of the effective operating magnetic flux densities to a pattern along which the acoustic diaphragm makes uniform vibrations, and it is possible to propose an electroacoustic transducer which is excellent in terms of acoustic characteristics.

(b) Since the portion where the magnet plate becomes thick is the intermediate portion in the radius direction, such a structure in which thick portions are not concentrated at one part can be obtained, whereby influences on the acoustic impedance, which are exerted by the depth of the acoustic pores drilled in the magnet plate can be totally dispersed, and partial uneven acoustic impedance can be reduced. Therefore, it is possible to prevent the acoustic diaphragm from irregular vibrations.

According to the electroacoustic transducer described in the sixth aspect of the invention, the following effects can be obtained in addition to those of any one of the first aspect through the fifth aspect.

(a) Since a number of acoustic pores that allows acoustic waves to pass through are formed in the magnet plate, acoustic waves generated in the entire range of the acoustic diaphragm can be discharged by reducing interference with each other in a speaker, headphone, etc., and electric signals having little distortion can be obtained in a microphone, etc., by reducing interference with sound received from the outside thereof.

(b) Where an acoustic diaphragm is provided between two magnet plates, acoustic pores may be provided in either one or both of the magnet plates. Where acoustic pores are formed in both of the magnet plates, the entire structure may be made symmetrical with respect to the vibration plane of the acoustic diaphragm. Therefore, an acoustically excellent structure can be obtained with respect to vibrations of the acoustic diaphragm.

According to the electroacoustic transducer described in the seventh aspect of the invention, the following effects can be obtained in addition to those of the sixth aspect.

(a) Since the distribution state of the effective operating magnetic flux densities in a conductor of the acoustic diaphragm can be adjusted by the arrangement state of the acoustic pores formed in the magnet plates, the distribution of the effective operating magnetic flux densities can be set to a pattern at which the acoustic diaphragm uniformly vibrates, wherein an electroacoustic transducer having excellent acoustic characteristics can be provided.

(b) Since the acoustic impedance can be adjusted by the arrangement state of the acoustic pores formed in the magnet plates, it is possible to optimize the transmission characteristics of acoustic waves generated in or received by the acoustic diaphragm and vibration characteristics of the acoustic diaphragm.

(c) By using a combination with those of varying the thickness and magnetic intensity of the magnet plates with respect to adjustment of distribution of the effective operating magnetic flux densities in a conductor of the acoustic diaphragm, it becomes possible to easily set the distribution of the effective operating magnetic flux densities formed in the conductor of the acoustic diaphragm to a pattern at which the acoustic diaphragm uniformly vibrates.

According to the electroacoustic transducer described in the eighth aspect of the invention, the following effects can be obtained in addition to those of any one of the first aspect through the seventh aspect.

(a) Since independent electroacoustic transducers that are different from each other in terms of sizes and acoustic characteristics thereof are concentrically (coaxially) constructed, and the entirety thereof is made into a composite type electroacoustic transducer, the electroacoustic transducers can be integrally and optimally disposed in accordance with application conditions such as a radiation area of acoustic waves, electric impedance, etc., wherein an electroacoustic transducer having excellent acoustic characteristics can be obtained. For example, if respective electroacoustic transducers are combined per frequency band for high frequency band, mid frequency band, and low frequency band, a composite type electroacoustic transducer can be easily constructed, which has excellent features in all the frequency bands.

(b) Even in a case where the radius of the magnet plate becomes large, the entirety of the magnet plate is divided into a plurality of ring-shaped magnet plates, the respectively divided magnet plates are independently magnetized to have a function as the magnet plate of the present invention, and corresponding N and S poles of the adjacent magnet plates are established so as to be inverse directions to each other, wherein it is possible to prevent the effective operating magnetic flux ratio from lowering.

(c) Since electroacoustic transducers having different acoustic characteristics are coaxially disposed to be made into a composite type, it is possible to propose an electroacoustic transducer having excellent phase characteristics and directivity characteristics.

According to the electroacoustic transducer described in the ninth aspect of the invention, the following effects can be obtained in addition to those of any one of the first aspect through the third aspect.

(a) Since the thickness at the intermediate portion between the center axis side and the outer circumferential edge side is made thinner than that at the central portion and the outer circumference portion in the magnet plate, it is possible to discharge acoustic waves generated from the acoustic diaphragm outsides with the interference brought about by the magnet plate being reduced. In addition, if the thickness is made remarkably thin at the intermediate portion of the magnet plate or the magnet plate is removed at the intermediate portion, and almost the entirety of the magnet plate is provided only at the central portion and the outer circumferential portion, the interference brought about by the magnet plate can be completely removed with respect to acoustic waves generated from the acoustic diaphragm.

(b) The central portion and outer circumferential portion of the magnet plate is made thick with the distribution of thickness at the intermediate portion of the magnet plate maintained at a pattern by which prescribed acoustic performance can be obtained, whereby the effective operating magnetic flux density at the position of the acoustic diaphragm can be increased, without increasing the interference of acoustic waves generated by the acoustic diaphragm with the magnet plate.

(c) By forming the thickness at the intermediate portion of the magnet plate thinner than that at the central portion and outer circumferential portion, it is possible to lower the effective operating magnetic flux density of the above-described intermediate portion particular to a case where the effective operating magnetic flux density of the above-described intermediate portion of the acoustic diaphragm is excessively high. Thereby, the distribution of the effective operating magnetic flux densities in a conductor of the acoustic diaphragm can be set to a pattern at which the acoustic diaphragm uniformly vibrates, and an electroacoustic transducer having excellent acoustic characteristics can be proposed.

What is claimed is:

1. An electroacoustic transducer, comprising:

one or a plurality of magnet plates, an entirety of which are formed like a disk or a ring, and each of the magnet plates having a plurality of partial areas each magnetized in a magnetizing direction; and an acoustic diaphragm disposed parallel to said magnet plates and having a conductor formed on a surface of the acoustic diaphragm and configured to vibrate in a vibration plane of the acoustic diaphragm;

wherein the magnetizing direction of each of the plurality of partial areas has a component of the magnetizing direction oriented in a direction parallel to a center axis or a radius direction of said magnet plates, and angles formed by said magnetizing directions of the plurality of partial areas with respect to the vibration plane of said acoustic diaphragm gradually differ from each other in accordance with a distance from the center axis of said magnet plates.

2. An electroacoustic transducer as set forth in claim 1, wherein said magnet plates comprise an aggregate of small magnets corresponding to said respective partial areas.

3. An electroacoustic transducer as set forth in claim 2, wherein at least one of said magnet plates, an entirety of which are formed like a disk or a ring, has a thickness gradually increasing from a circumferential edge of the magnetic plate toward a center axis.

4. An electroacoustic transducer as set forth in claim 2, wherein at least one of said magnet plates, an entirety of which are formed like a disk or a ring, has a thickness at an intermediate portion between a center axis and a circumferential edge of the magnetic plate which is thicker than portions of the magnetic plate near said center axis and near said outer circumferential edge.

5. An electroacoustic transducer as set forth in claim 2, wherein said magnet plates have acoustic pores that allow acoustic waves generated to pass therethrough.

6. An electroacoustic transducer as set forth in claim 5, wherein the size, arrangement density, and arrangement pattern of said acoustic pores disposed in said magnet plates gradually differ from each other from a center axis of said magnet plates toward an outer circumferential edge of the magnet plates.

7. An electroacoustic transducer as set forth in claim 2, wherein at least one of said magnet plates which are formed like a disk or ring as an entirety has a thickness at an intermediate portion between a center axis and an outer circumferential edge of the magnetic plate thinner than portions of the magnetic plate near the center axis and near the outer circumferential edge.

8. An electroacoustic transducer as set forth in claim 2, wherein each of the plurality of magnet plates has an inner circumferential edge defining an opening about a center axis, and having an inner electroacoustic transducer disposed concentrically within the opening.

9. An electroacoustic transducer as set forth in claim 8, wherein the inner electroacoustic transducer comprises:

one or a plurality of inner magnet plates, an entirety of which is formed like a disk or a ring, and each of the inner magnet plates has a plurality of partial areas each magnetized in a magnetizing direction; and an inner acoustic diaphragm disposed parallel to said inner magnet plates and having a conductor formed on a surface of the inner acoustic diaphragm thereof and configured to vibrate in a vibration plane of the inner acoustic diaphragm;

wherein the magnetizing direction of each of the plurality of partial areas of the inner magnet plates has a component of the magnetizing direction oriented in a direction parallel to the center axis or in a radius direction of said inner magnet plates, and angles formed by said magnetizing directions of the plurality of partial areas of said inner magnet plates with respect to the vibration plane of said inner acoustic diaphragm gradually differ from each other in accordance with a distance from the center axis of said inner magnet plates.

* * * * *

UNITED STATES PATENT AND TRADEMARK OFFICE

CERTIFICATE OF CORRECTION

PATENT NO. : 7,142,687 B2
APPLICATION NO. : 10/470693
DATED : November 28, 2006
INVENTOR(S) : Akito Hanada It is certified that error appears in the above-identified patent and that said Letters Patent is hereby corrected as shown below:

On Title Page

Please correct the inventor's address on the front page as shown below:

Item

(76) Inventor: Akito Hanada, 3-19, Orio 4-chome, Yahatanishi-ku, "Kitakyashu-shi" --Kitakyushu-shi--, Fukouoka "807-0828" --807-0825-- Japan Signed and Sealed this Tenth Day of April, 2007

JON W. DUDAS
*Director of the United States Patent and Trademark Office*